US009268279B1

(12) United States Patent
Murayama

(10) Patent No.: US 9,268,279 B1
(45) Date of Patent: Feb. 23, 2016

(54) IMAGE FORMING APPARATUS PERFORMING MARK DATA GENERATING PROCESSES TWICE AND DETERMINING WHETHER DIFFERENCE BETWEEN TWO SETS OF DATA BASED ON MARK DATA GENERATING PROCESSES IS WITHIN PRESCRIBED RANGE

(71) Applicant: BROTHER KOGYO KABUSHIKI KAISHA, Nagoya-shi, Aichi-ken (JP)

(72) Inventor: Kentaro Murayama, Kasugai (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/836,033

(22) Filed: Aug. 26, 2015

(30) Foreign Application Priority Data

Aug. 27, 2014 (JP) ..... 2014-172612
Sep. 18, 2014 (JP) ..... 2014-189877

(51) Int. Cl.
*G03G 15/00* (2006.01)
*G03G 15/08* (2006.01)

(52) U.S. Cl.
CPC ..... *G03G 15/50* (2013.01); *G03G 15/0889* (2013.01); *G03G 15/5058* (2013.01)

(58) Field of Classification Search
CPC ..... G03G 15/5058
See application file for complete search history.

(56) References Cited

U.S. PATENT DOCUMENTS

2002/0089579 A1 7/2002 Yamanaka et al.
2003/0137578 A1 7/2003 Yamazaki
2006/0165422 A1 7/2006 Kikuchi et al.
2006/0165425 A1* 7/2006 Matayoshi ..... G03G 15/5058 399/49
2007/0019258 A1 1/2007 Hattori
2009/0296116 A1 12/2009 Asai
2010/0008681 A1 1/2010 Nagatsuka
2010/0027036 A1 2/2010 Miyata
2011/0076040 A1* 3/2011 Uchidate ..... G03G 15/0131 399/49
2012/0237232 A1* 9/2012 Goto ..... G03G 15/0194 399/49
2015/0147099 A1* 5/2015 Tosaka ..... G03G 15/5058 399/301
2015/0205242 A1* 7/2015 Mimura ..... G03G 15/55 399/46

FOREIGN PATENT DOCUMENTS

JP 11-252386 A 9/1999
JP 2002-207337 A 7/2002
JP 2003-241590 A 8/2003
JP 2004-157415 A 6/2004
JP 2005-172945 A 6/2005

(Continued)

*Primary Examiner* — W B Perkey
(74) *Attorney, Agent, or Firm* — Merchant & Gould PC

(57) ABSTRACT

In an image forming apparatus, a processor is configured to: determine whether prescribed criterion is met, the prescribed criterion indicating that a non agitation period of time, during which the agitator has not agitated the toner, has passed a predetermined period of time; perform a mark data generating process in which mark data is generated by forming a mark and reading the formed mark when the prescribed criterion is met; perform another mark data generating process in which another mark data is generated by forming another mark and reading the formed another mark after performing the mark data generating process; determine whether a difference between the mark data and the another mark data is within a prescribed range; and determine an adjustment value on a basis of at least one of the mark data and the another mark data when the difference is within the prescribed range.

14 Claims, 13 Drawing Sheets

(56) References Cited

FOREIGN PATENT DOCUMENTS

| | | | |
|---|---|---|---|
| JP | 2006-184372 | A | 7/2006 |
| JP | 2006-284773 | A | 10/2006 |
| JP | 2007-36370 | A | 2/2007 |
| JP | 2007-124435 | A | 5/2007 |
| JP | 2009-289009 | A | 12/2009 |
| JP | 2010-32958 | A | 2/2010 |
| JP | 2010-39477 | A | 2/2010 |
| JP | 2011-128526 | A | 6/2011 |

* cited by examiner

IMAGE FORMING APPARATUS PERFORMING MARK DATA GENERATING PROCESSES TWICE AND DETERMINING WHETHER DIFFERENCE BETWEEN TWO SETS OF DATA BASED ON MARK DATA GENERATING PROCESSES IS WITHIN PRESCRIBED RANGE

CROSS REFERENCE TO RELATED APPLICATION

This application claims priorities from Japanese Patent Application No. 2014-172612 filed Aug. 27, 2014 and Japanese Patent Application 2014-189877 filed Sep. 18, 2014. The entire content of each of these priority applications is incorporated herein by reference.

TECHNICAL FIELD

The present disclosure relates to an image forming apparatus that forms an image using toner and, more particularly, to technology concerning formation of mark for a correction process and toner agitation.

BACKGROUND

Conventionally, an image forming apparatus performs a correction process for suppressing displacement of an image or density unevenness. In a case of a displacement correction, for example, a mark for displacement correction is formed on a conveying belt before formation of a target image, and a displacement amount is acquired on the basis of a detection result of the mark. Then, an image forming timing is adjusted on the basis of the acquired displacement amount.

A conventional image forming apparatus forms an image using toner. In this image forming apparatus, the toner in a developing device is agitated before an image forming operation so as to stabilize a toner charge amount. Japanese Patent Application Publication No. 2011-128526 discloses that an agitation time is controlled according to a ratio between a toner supply amount and a carrier supply amount.

SUMMARY

However, the above conventional technology has the following problem. That is, when a predetermined toner agitation time is ensured, toner may be agitated more than necessary in a state where the toner is already charged stably. A user waits for the toner agitation time before start of image formation, so it is desirable that an agitation time becomes short. On the other hand, when the agitation time is too short, image quality may be degraded.

The present disclosure has been made to solve the above described problem. That is, an object of the present disclosure is to provide a technology capable of suppressing both reduction in a printing throughput and reduction in image quality in an image forming apparatus that forms an image using toner.

In order to attain the above and other objects, the disclosure provides an image forming apparatus. The image forming apparatus includes an accommodating chamber, an agitator, a sensor, and a processor. The accommodating chamber is configured to accommodate toner. The agitator is provided in the accommodating chamber and configured to agitate the toner. The image forming unit is configured to form an image based on image data by using the toner. The processor is configured to: determine whether prescribed criterion is met, the prescribed criterion indicating that a non agitation period of time, during which the agitator has not agitated the toner, has passed a predetermined period of time; perform a mark data generating process in which mark data is generated by forming a mark with the image forming unit and then reading the formed mark with sensor when the prescribed criterion is met; perform another mark data generating process in which another mark data is generated by forming another mark with the image forming unit and then reading the formed another mark with the sensor after performing the mark data generating process; determine whether a difference between the mark data and the another mark data is within a prescribed range; and determine an adjustment value to adjust the image on a basis of at least one of the mark data and the another mark data when the difference is within the prescribed range.

According to another aspects, the disclosure provides a non-transitory computer readable storage medium storing a set of program instructions installed on and executed by a computer for controlling an image forming apparatus including an accommodating chamber configured to accommodate toner; an agitator provided in the accommodating chamber and configured to agitate the toner; an image forming unit configured to form an image based on image data by using the toner; and a sensor. The program instructions includes: determining whether prescribed criterion is met, the prescribed criterion indicating that a non agitation period of time, during which the agitator has not agitated the toner, has passed a predetermined period of time; performing a mark data generating process in which mark data is generated by forming a mark with the image forming unit and then reading the formed mark with sensor when the prescribed criterion is met; performing another mark data generating process in which another mark data is generated by forming another mark with the image forming unit and then reading the formed another mark with the sensor after performing the mark data generating process; determining whether a difference between the mark data and the another mark data is within a prescribed range; and determining an adjustment value to adjust the image on a basis of at least one of the mark data and the another mark data when the difference is within the prescribed range.

According to still another aspects, the disclosure provides a method for controlling an image forming apparatus including an accommodating chamber configured to accommodate toner; an agitator provided in the accommodating chamber and configured to agitate the toner; an image forming unit configured to form an image based on image data by using the toner; and a sensor. The method includes: determining whether prescribed criterion is met, the prescribed criterion indicating that a non agitation period of time, during which the agitator has not agitated the toner, has passed a predetermined period of time; performing a mark data generating process in which mark data is generated by forming a mark with the image forming unit and then reading the formed mark with sensor when the prescribed criterion is met; performing another mark data generating process in which another mark data is generated by forming another mark with the image forming unit and then reading the formed another mark with the sensor after performing the mark data generating process; determining whether a difference between the mark data and the another mark data is within a prescribed range; and determining an adjustment value to adjust the image on a basis of at least one of the mark data and the another mark data when the difference is within the prescribed range.

BRIEF DESCRIPTION OF THE DRAWINGS

The particular features and advantages of the disclosure as well as other objects will become apparent from the following description taken in connection with the accompanying drawings, in which.

DETAILED DESCRIPTION

A printer 100 according to a first embodiment will be described while referring to the accompanying drawings. The printer 100 is configured to form an image by an electricphotographic process.

Figure 1:
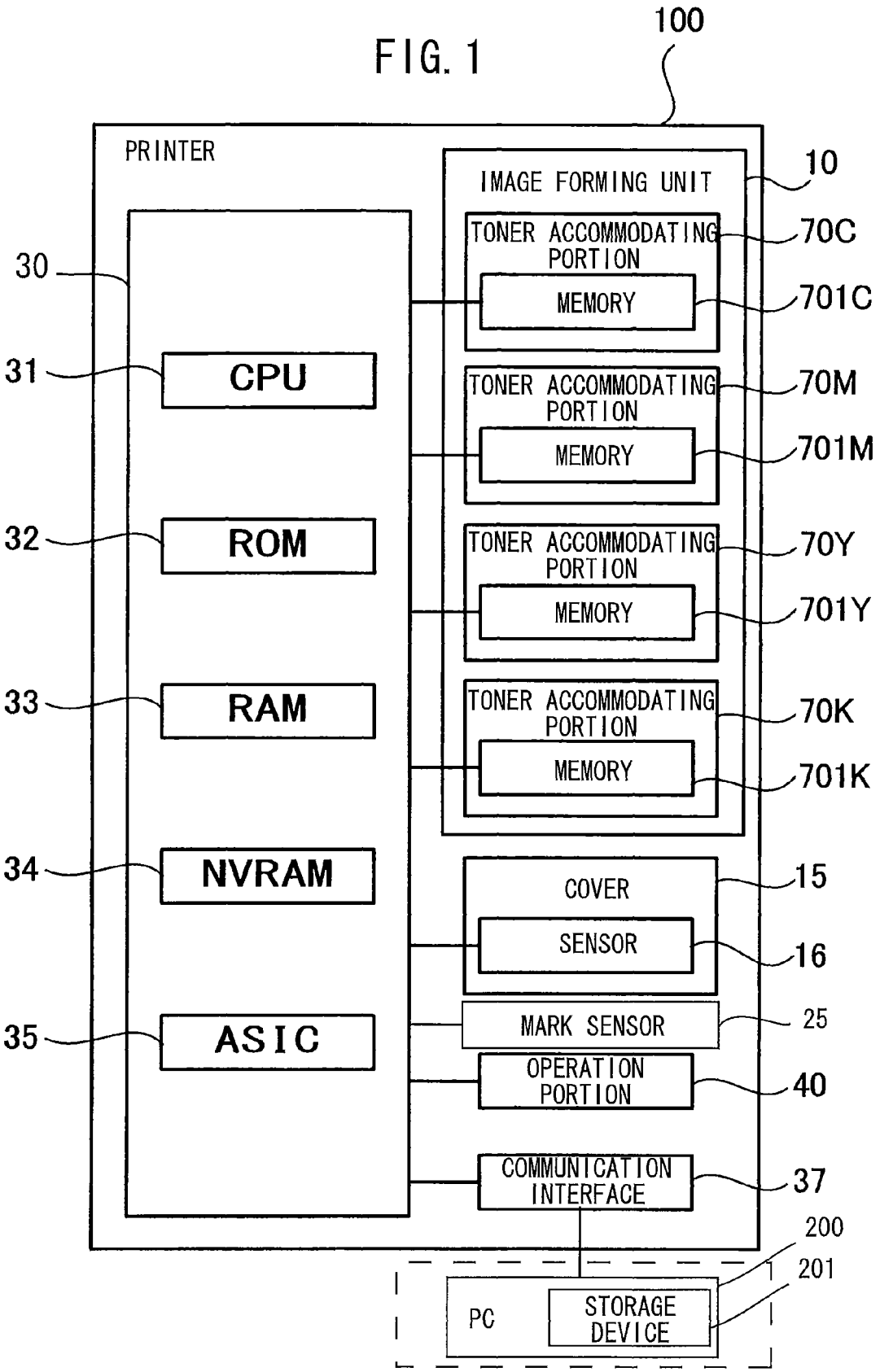
FIG. 1 is a block diagram illustrating electrical configurations of a printer according to a first embodiment.

As shown in FIG. 1, the printer 100 includes a controller 30. The controller 30 includes a CPU 31, a ROM 32, a RAM 33, a NVRAM (nonvolatile RAM) 34, and an ASIC (Application Specific Integrated Circuit) 35. The printer 100 further includes an image forming unit 10, a mark sensor 25, an operation portion 40, and a communication interface 37, which are controlled by a CPU 31. The image forming unit 10 forms an image by an electrophotographic system. The operation portion 40 receives an input operation from a user. The communication interface 37 is used for connecting to an external device. A controller 30 of FIG. 1 is a generic term referring to hardware, such as the CPU 31, used for controlling the printer 100 and does not always indicate a single hardware actually existing in the printer 100.

The ROM 32 stores various control programs for controlling the printer 100, various settings, initial values, and the like. The RAM 33 is used as a working area where various control programs are read or a storage area where image data is temporarily stored.

The CPU 31 controls components of the printer 100 while storing processing results thereof in the RAM 33 or the NVRAM 34 according to a signal transmitted from the control program read from the ROM 32 or various sensors. The CPU 31 is an example of a processor. Alternatively, the controller 30 or the ASIC 35 may serve as the processor.

The communication interface 37 is hardware that can perform communication with an external device. For example, the communication interface 37 is a wired LAN interface, a wireless LAN interface, a serial communication interface, a parallel communication interface, a USB, or a facsimile interface. The printer 100 can receive a job instructing the image forming unit 10 to form an image from the external device through the communication interface 37.

Figure 2:
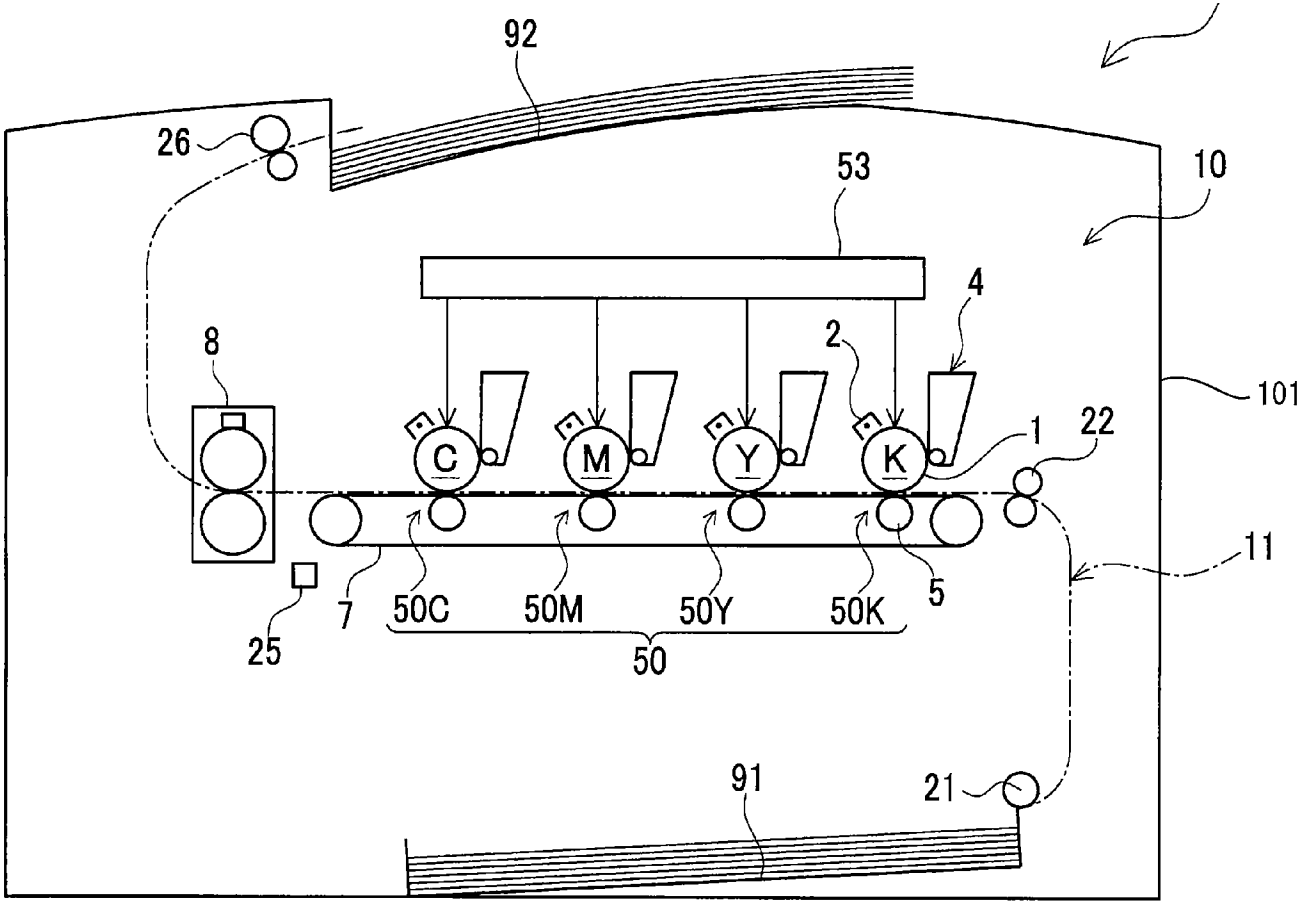
FIG. 2 is a cross section illustrating an internal structure of the printer according to the first embodiment.

As shown in FIG. 2, the printer 100 includes a casing 101. The image forming unit 10 is provided in the casing 101. The operation portion 40 is provided on the casing 101 and includes various buttons for receiving an input operation from a user and a touch panel for displaying a message or setting content. For example, the various buttons include an execution button for making the image forming unit 10 form an image and a cancel button for inputting an image forming cancel command. The operation portion 40 can receive various inputs also when a user touches the touch panel with his or her finger.

The printer 100 (especially, the image forming unit 10) according to the embodiment can form a color image. As described later, the image forming unit 10 has toner accommodating portions 70C, 70M, 70Y, and 70K of different colors which are individually mountable to and detachable from the casing 101. The toner accommodating portions 70C, 70M, 70Y, and 70K have memories 701C, 701M, 701Y, and 701K, respectively. Hereinafter, if the toner accommodating portions 70C-70K or memories 701C-701K need not be distinguished from each other, suffixes Y, M, C, and K are omitted. The controller 30 of the printer 100 can read and write information from and into the memory 701 of the toner accommodating portion 70 attached to the casing 101.

The printer 100 further has: a cover 15 that is opened and closed when the toner accommodating portion 70 is mounted to and detached from the casing 101 and an open and close sensor 16 for detecting an open state and a closed state of the cover 15. The open and close sensor 16 outputs different signals between when the cover 15 opens and when the cover 15 is closed. The printer 100 can determine whether the cover 14 is in the open state or the closed state on the basis of the output signal of the open and close sensor 16.

The mark sensor 25 reads marks (that is "a pattern image") for correction formed by the image forming unit 10. Details of the correction will be described later.

A configuration of the image forming unit 10 of the printer 100 will be explained with reference to FIG. 2. The image forming unit 10 includes a process unit 50, an exposure device 53, a fixing device 8, a sheet supply tray 91, a sheet discharge tray 92, and a conveying belt 7. The process unit 50 forms a toner image by an electrophotographic system and transfers the toner image onto a sheet. The exposure device 53 irradiates the process unit 50 with light. The fixing device 8 fixes unfixed toner on the sheet. Sheets before image transfer are placed on the sheet supply tray 91. Sheets after image transfer is placed on the sheet discharge tray 92. The conveying belt 7 conveys the sheet to a transfer position of the process unit 50 from the sheet supply tray 91.

The printer 100 includes a conveying path 11 (indicated by a dashed detted line of FIG. 2). The conveying path 11 has a substantially S-like shape such that the sheet on the sheet supply tray 91 positioned at a bottom of the printer 100 is guided to the sheet discharge tray 92 positioned at an upper portion of the printer 100, via a sheet supply roller 21, registration rollers 22, the process unit 50, the fixing device 8, and discharge rollers 26.

The process unit 50 can form a color image and has process units 50C, 50M, 50Y, and 50K. The process units 50C, 50M, 50Y, and 50K respectively corresponds to colors of cyan (C), magenta (M), yellow (Y), and black (K). That is, the process unit 50C forms an image of color C, the process unit 50M forms an image of color M, the process unit 50Y forms an image of color Y, and the process unit 50K forms an image of color K. The process units 50C, 50M, 50Y, and 50K are arranged side by side, at equal intervals, along the conveying belt 7 in this order from a downstream side in a sheet conveying direction. The arrangement order of the process units is not limited to this.

The process unit 50K includes a photoconductive member (photosensitive drum) 1 having a drum shape (cylindrical shape), a charging device 2 that uniformly charges a surface of the photosensitive member 1, a developing device 4 that develops an electrostatic latent image on the photoconducitive member 1 by using toner. The printer 100 includes transfer devices (transfer rollers) 5. One of the transfer devices 5 is disposed below each of the process units 50C, 50M, 50Y, and 50K with the conveying belt 7 interposed therebetween. That is, the photosensitive member 1 and the transfer device 5 are disposed so as to contact the conveying belt 7. The process unit 50K, in cooperation with the corresponding transfer device 5, transfers a toner image on the photosensitive member 1 onto the sheet or the conveying belt 7. The process units 50C, 50M, and 50Y also have the same configuration as that of the process unit 50K.

Figure 3:
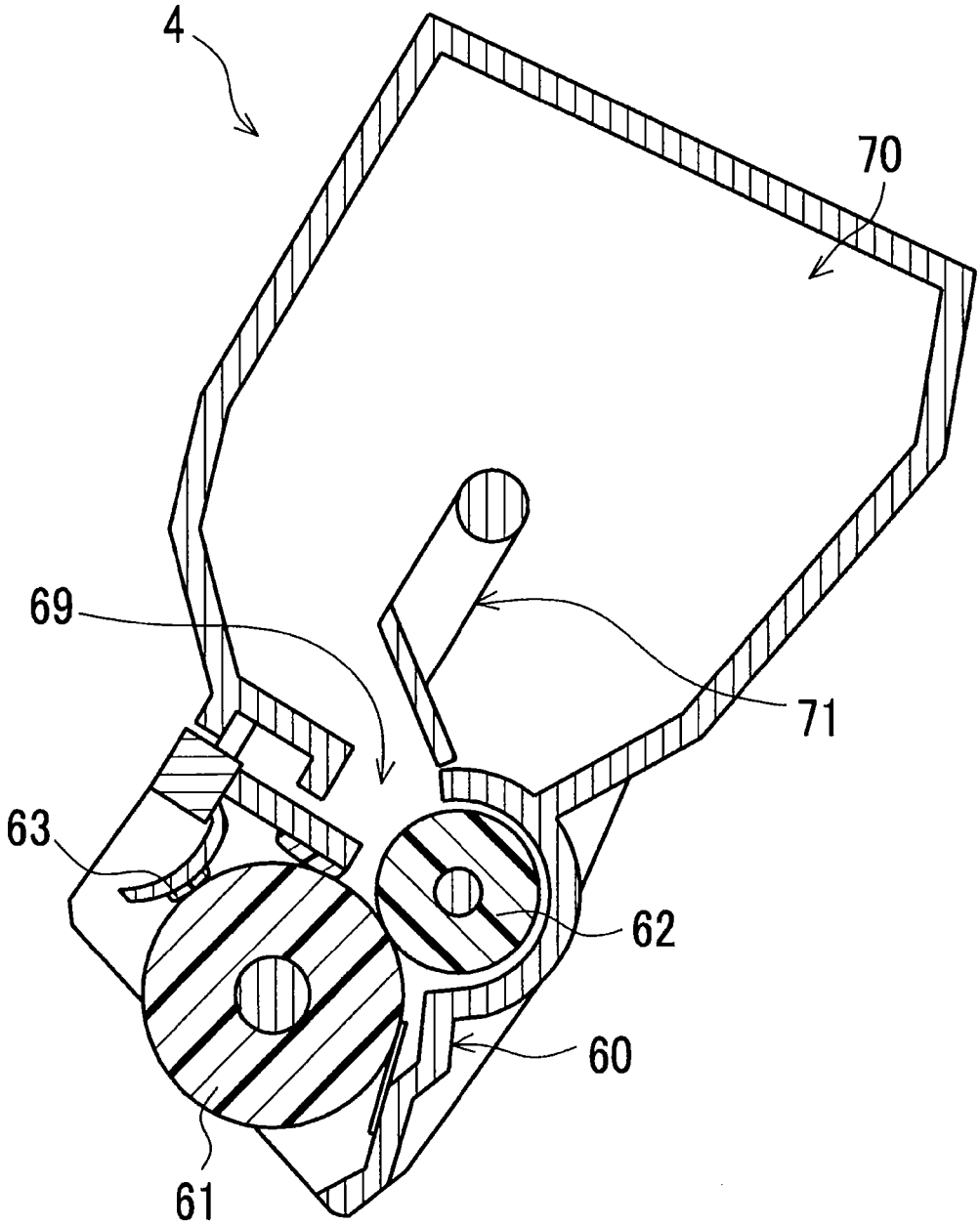
FIG. 3 is a cross section illustrating configurations of a developing device according to the first embodiment.

As illustrated in FIG. 3, the developing device 4 includes a developing unit 60 and a toner accommodating portion 70 which are communicate with each other through a supply port 69. In the embodiment, non-magnetic, single-component toner is accommodated in the toner accommodating portion 70 as a developing agent. The toner accommodating portion 70 is an example of an accommodating portion. As described above, the toner accommodating portion 70 is attachable to and detachable from to the casing 101. Only the toner accommodating portion 70 for each color may be configured to be attachable to and detachable from the casing 101. Alternatively, the entire developing device 4 may be configured to be attachable to and detachable from the casing 101, or a part of the developing device 4 that includes the toner accommodating portion 70 may be configured to be attachable to and detachable from the casing 101.

The developing unit 60 includes a developing roller 61 that carries toner and feeds the toner to the photosensitive member 1, a toner supply roller 62 that supplies the toner to the developing roller 61 and scrapes the toner on the developing roller 61, and a regulation member 63 that regulates a thickness of the toner on the developing roller 61 and charges the toner.

The toner accommodating portion 70 is provided with an agitator 71 for agitating the toner. The agitator 71 is rotated by a motor (not shown) to agitate the toner inside the toner accommodating portion 70. The agitation of the toner by the agitator 71 eliminates unevenness in the toner and stabilizes the charging state of the toner. The printer 100 drives the agitator 71 during an image formation process, for example. The agitator 71 is an example of an agitator of the invention. A part of the agitated toner is discharged toward the developing unit 60 through the supply port 69.

The toner discharged from the supply port 69 to the developing unit 60 is supplied to the developing roller 61 by rotation of the toner supply roller 62. At this time, the toner is friction-charged between the toner supply roller 62 and the developing roller 61. The toner supplied onto the developing roller 61 enters between the regulation member 63 and the developing roller 61 with rotation of the developing roller 61 and is reduced in thickness while being friction-charged. A part of the toner on the developing roller 61 at a position opposed to the photosensitive member 1 is moved to the photosensitive member 1 and develops the electrostatic latent image formed on the photosensitive member 1.

In each of the process units 50C, 50M, 50Y, and 50K shown in FIG. 2, the surface of the photosensitive member 1 is uniformly charged by the corresponding charging device 2 and is thereafter exposed to light from the exposure device 53, whereby the electrostatic latent image corresponding to an intended image subject to the image formation is formed on the surface of the photosensitive member 1. The toner is supplied to the photosensitive member 1 from the developing device 4 (specifically, the developing roller 61). As a result, the electrostatic latent image on the surface of the photosensitive member 1 is visualized as a toner image.

The image forming unit 10 picks up the sheets placed on the sheet supply tray 91 one by one and feeds the sheet onto the conveying belt 7. The process unit 50, in cooperation with the transfer device 5, transfers the formed toner image onto the sheet. Here, in color printing, the toner image is formed by each of the process units 50C, 50M, 50Y, and 50K, and the formed toner images are superimposed on the sheet. In monochrome printing, the toner image is formed by only the process unit 50K, and is transferred onto the sheet. Thereafter, the sheet onto which the toner image is transferred is conveyed to the fixing device 8, and the toner image is thermally fixed onto the sheet by the fixing device 8. The resultant sheet is discharged to the sheet discharge tray 92.

Figure 4:
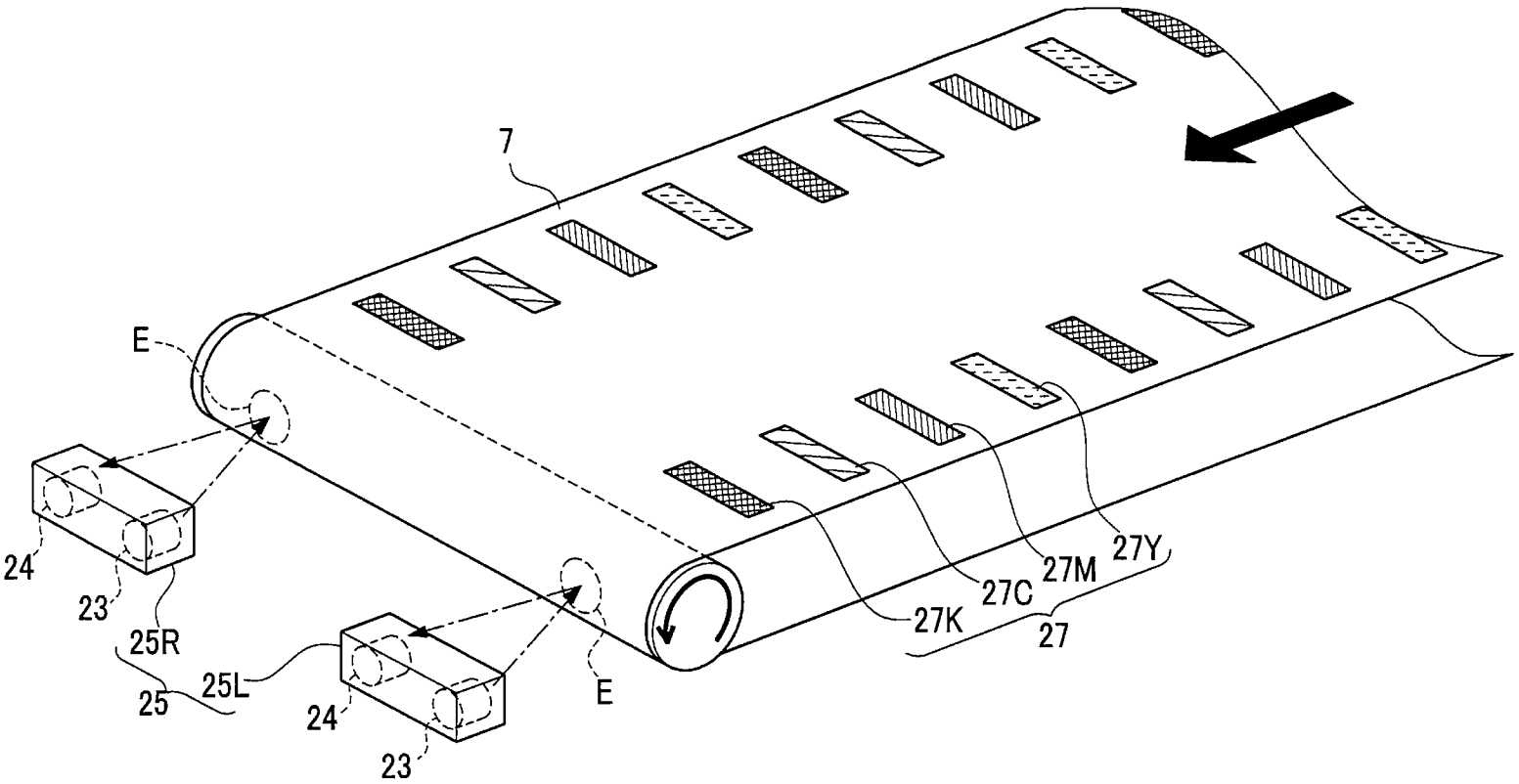
FIG. 4 is an explanatory diagram illustrating positions of mark sensors according to the first embodiment.

The printer 100 performs a correction process to prevent density unevenness or displacement from occurring in the images formed by the process units 50C, 50M, 50Y, and 50K. A procedure of the correction process is as follows: correction marks (a patter images) are formed by the process units 50C, 50M, 50Y, and 50K; the formed correction marks are transferred onto the conveying belt 7; and correction values for bringing a current image close to an ideal image are determined on the basis of a detection result of each mark. As shown in FIG. 4, the mark sensor 25 is disposed at a position downstream of the process units 50C, 50M, 50Y, and 50K in a moving direction of the conveying belt 7 and where the sheet does not pass. The printer 100 uses the mark sensor 25 to detect the correction marks formed on the conveying belt 7. The mark sensor 25 is an example of a sensor.

Specifically, as illustrated in FIG. 4, the mark sensor 25 includes two sensors 25R and 25L. The sensor 25R is disposed on a right side of the conveying belt 7 in a width direction thereof and the sensor 25L is disposed on a left side thereof. Each of the sensors 25R and 25L is a reflective type optical sensor provided with a pair of a light emitting element 23 such as an LED and a light receiving element 24 such as a phototransistor. Each light emitting element 23 of the mark sensors 25R and 25L diagonally irradiates a region E (see a circular frame written by a dashed-line) on a surface of the conveying belt 7 with light, and the corresponding light receiving element 24 receives the light reflected by the conveying belt 7 or a mark (a mark 27, for example) formed on the conveying belt 7. The correction mark can be detected by a difference between a light receiving amount when the correction mark 27 passes the region E and a light receiving amount directly reflected from the surface of the conveying belt 7. Here, the mark 27 of FIG. 4 is an example of a mark for a displacement correction.

When an execution condition of each of the correction process described below is satisfied, the printer 100 forms the correction marks and acquires mark data corresponding to a current state on the basis of the detection result from the mark sensor 25. Then, the printer 100 calculates one or more correction values for bringing a current image close to an ideal image on the basis of the acquired mark information. Further, the printer 100 uses the calculated correction values in an image formation operation. In order to form a proper image, it is required to acquire mark data adequately reflecting the current state.

The following describes various correction processes executed in the printer 100. Examples of the correction processes executed by the printer 100 according to the embodiment include a displacement correction, a developing bias correction, and a gamma correction. The correction process is not limited to these examples.

The displacement correction acquires correction values for adjustment of a dynamic displacement of an image position and a static displacement of an image position. The dynamic displacement of the image position is caused by eccentricity of the photosensitive member 1 or rollers (rollers 21, 22, and other conveying rollers provided in the printer 100 (not shown), for example), or by deviation of a pitch of gears provided in the printer 100 (not shown) that rotate the photosensitive member 1 or these rollers. The static displacement of the image position is caused by displacement of an installation position of the photosensitive member 1 or the exposure device 53. In the displacement correction, the printer 100 forms marks 27K, 27C, 27M, and 27Y as illustrated in FIG. 4. For example, a pair of marks is arranged on widthwise end portions of the conveying belt 7 so that the pair of marks are read by corresponding mark sensors 25R and 25L at read positions (or regions E). In the marks of respective colors are elongated in a main scanning direction (the widthwise direction of the conveying belt 7), and arranged side by side in a sub-scanning direction orthogonal to the main scanning direction. That is, the marks of different colors are adjacent to one another in the sub-scanning direction. The mark sensor 25 reads these marks. The CPU 31 calculates intervals between the marks, and thereby acquires a periodic displacement amount that periodically emerges in detection results of marks or a displacement amount between marks of the different colors. A correction value for displacement is one example of adjustment value for adjusting an image.

For the displacement correction, the printer 100 reads a position of each formed mark 27. More specifically, the printer 100 reads a leading edge or a rear edge of each mark 27. The mark data for the displacement correction is position data of each mark 27. There is one position to be read for each mark 27, so that a sampling number of the mark data for the displacement correction corresponds to the number of the formed marks 27. That is, the larger the number of the formed marks 27, the larger the sampling number of the mark data for the displacement correction. The sampling number is the number of times the mark of each color is read in one correction process, i.e., the number of mark data that can be acquired for each color.

Figure 5:
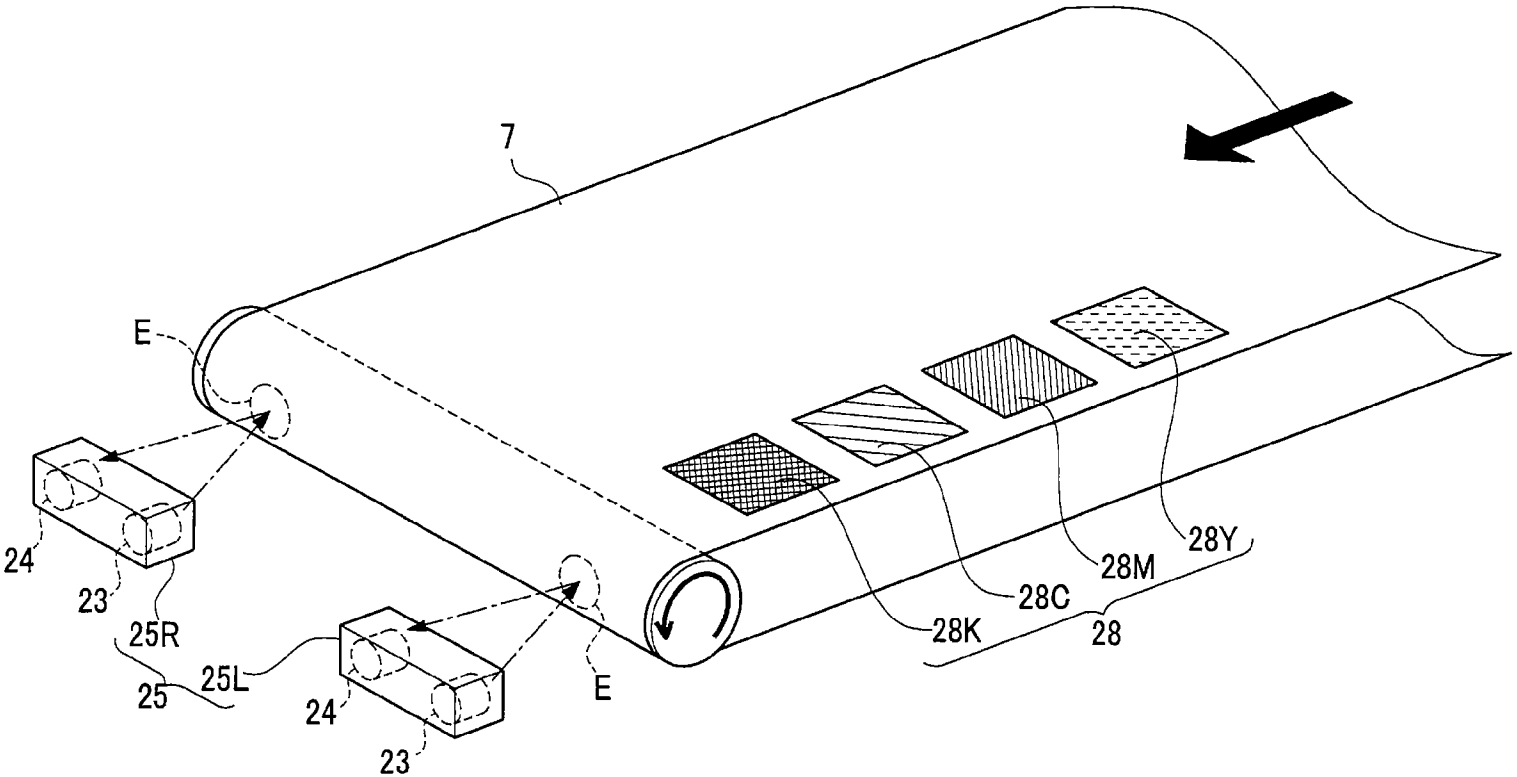
FIG. 5 is an explanatory diagram illustrating marks for a developing bias correction.

The developing bias correction is a process for acquiring a correction value for adjusting a deviation between an ideal density prescribed in the printer 100 and a density of the actually formed mark. As illustrated in FIG. 5, in the developing bias correction, the printer 100 forms the marks 28K, 28C, 28M, and 28Y of respective colors each having a density of 100%. The printer 100 reads the marks 28 by the mark sensor 25 and acquires density data by calculating a current density based on a light receiving amount. Then, the printer 100 acquires a developing bias correction value for bringing the formed density close to a target density. For example, the printer 100 uses a linear function between the density and a current bias value to calculate an adjusting amount of the developing bias value from a difference between the current density and the target density and acquires an adjusting value as the developing bias correction value. The mark data for the developing bias correction is density data of each mark 28. The developing bias correction value is an example of an adjusting value for image adjustment.

As illustrated in FIG. 5, the developing bias correction mark 28 has a size larger in the moving direction of the conveying belt 7 than that of the displacement correction mark 27. In the developing bias correction, the printer 100 controls the mark sensor 25 to perform reading operations at predetermined time intervals to read a plurality of locations inside each mark 28, thereby acquiring a plurality of density data for each mark 28. When the reading interval is constant, the larger the size of each mark 28 in the moving direction of the conveying belt 7, the larger the sampling number of the density data. The larger the size of each mark 28 in the moving direction of the conveying belt 7, or the larger the number of the formed marks 28, the larger the sampling number of the mark data for the developing bias correction.

The image density can be corrected also by correcting an exposure bias. When correcting the exposure bias, the printer 100 forms and reads the marks 28, thereby acquiring a correction value of the exposure bias in the same manner as in the developing bias correction. The exposure bias correction value is an example of an adjusting value for image adjustment.

Figure 6:
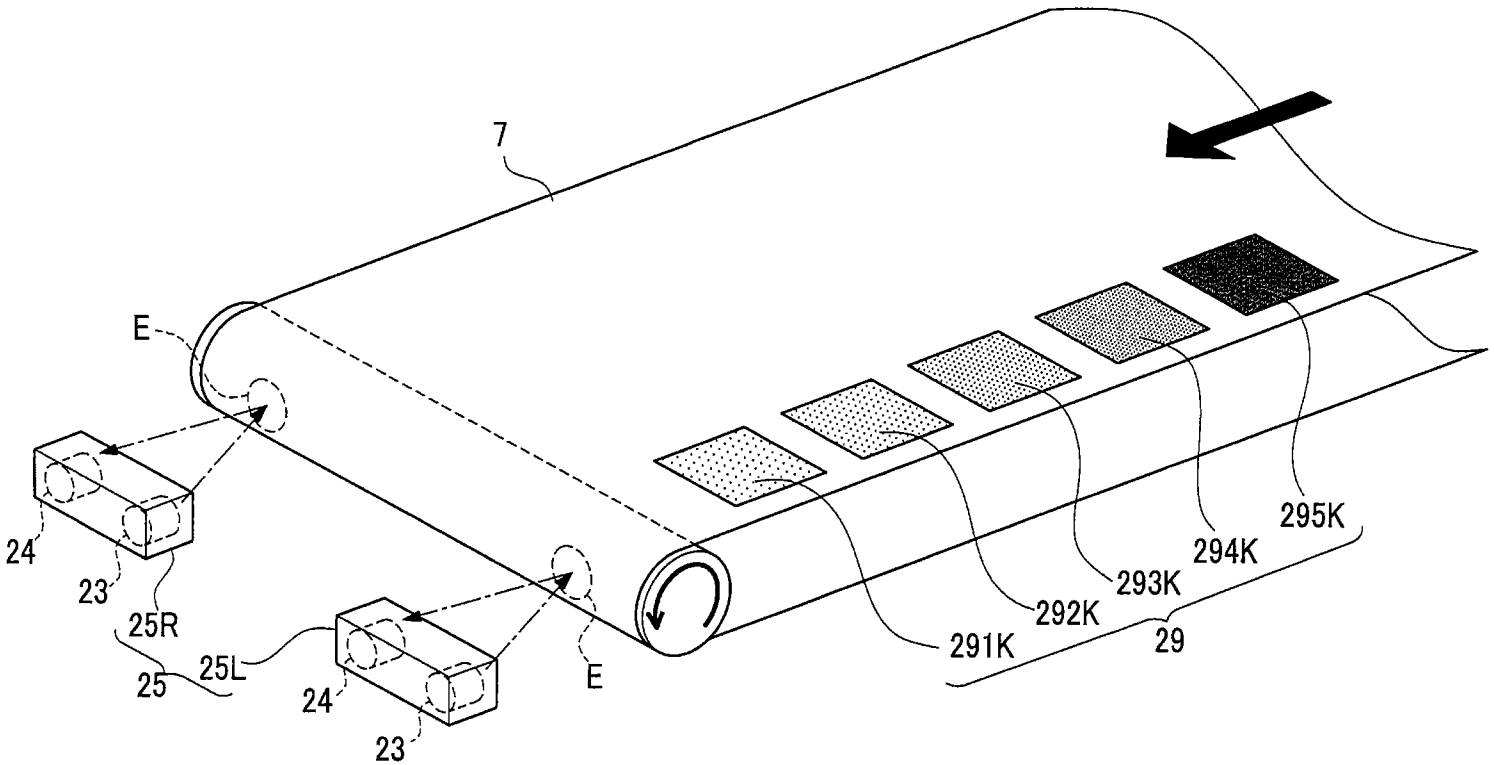
FIG. 6 is an explanatory diagram illustrating marks of a plurality of densities.

The gamma correction is a process for correcting a deviation between a designated density (designated gradation level) designated from an external computer and an output density of the printer 100 itself. In the gamma correction, as shown in FIG. 6, the printer 100 forms marks 291K, 292K, 293K, 294K, and 295K of a plurality of densities (e.g., 20%, 40%, 60%, 80%, 100%) for each color. The printer 100 reads these marks by the mark sensor 25 and calculates an actual density based on a light receiving amount, thereby acquiring density data. The printer 100 identifies a change characteristic of the density of each color based on a correlation among the marks of the plurality of densities and creates a correlation table between the change characteristic and the gradation level designated from the external computer. Each value in the relative relationship table is an example of adjusting value for image adjustment.

Like the developing bias correction mark 28, the gamma correction mark 29 has a certain degree of size. That is, the printer 100 forms marks of a plurality of densities for each color as the gamma correction marks. In the gamma correction, the printer 100 acquires a plurality of density data for each mark. When a reading frequency is constant, the larger the size of each mark 29 in the moving direction of the conveying belt 7, the larger the sampling number of the density data. The larger the size of each mark 29 in the moving direction of the conveying belt 7, or the larger the number of the formed marks 29, the larger the sampling number of the mark data for the gamma correction.

The printer 100 forms the developing bias correction marks 28 and gamma correction marks 29 at one of read positions of the mark sensors 25R and 25L with respect to the widthwise direction. Although these marks may be formed at both reading positions of the mark sensors 25R and 25L in the widthwise direction, they are preferably formed at one of the reading positions of the mark sensors 25R and 25L in the widthwise direction in order to acquire proper mark data while suppressing a use amount of the toner.

When receiving an execution instruction of a print job, the printer 100 determines whether an execution condition of each correction process is satisfied. When determining that the execution condition is satisfied, the printer 100 executes the correction process that satisfies the execution condition before executing the print job.

That is, the correction process is not executed immediately after the execution condition is satisfied, but executed prior to execution of the print job after an execution condition of the print job is satisfied. Then, the printer 100 corrects operation of the components according to the correction value determined in the correction process and, after that, executes the print job. A plurality of correction process execution conditions are set for each correction process. For example, execution conditions for each correction process may include: a condition that a cover is opened; a condition that a power supply is input; a condition that a user instruction is input; a condition that the printer 100 prints the number of sheets larger than or equal to a prescribed number; a condition that amount (or number) of rotations of the agitator 71 is equal to or higher than a threshold value; a condition that a continuous activation time of the printer 100 is equal to or higher than a threshold value; and a condition that environmental conditions (humidity, temperature, and etc.) are changed. Or, a combination of these conditions may be used as an execution condition of each correction process. For example, an execution process of one correction process may be one of the condition that a power supply is input and the condition that a user instruction is input. In this case, when condition that a power supply is input or when a user instruction is input, the execution condition is met. Alternatively, one correction process may be a combination of the condition that a power supply is input and the condition that a user instruction is input. In this case, both when a power supply is input and when a user instruction is input, the execution condition is met. To detect the environmental conditions, a sensor (not shown) may be provided in the printer 100.

There may be a case where, in the printer 100, execution conditions of a plurality of correction process are satisfied simultaneously. When the execution conditions of the plurality of correction process are satisfied and the plurality of correction processes is executed, an execution order thereof is previously determined. Specifically, the density correction such as the developing bias correction is executed first, followed by execution of the displacement correction or the gamma correction.

In the printer 100, when the execution condition of the gamma correction is satisfied, the execution condition of the developing bias correction is also satisfied. Both the developing bias correction and the gamma correction are density correction for suppressing density unevenness. The developing bias correction corrects a density deviation in the entire gradation level range which is insufficiency or excess of the density occurring over the entire gradation level range. On the other hand, the gamma correction corrects a density deviation for each gradation level which is insufficiency or excess of the density occurring in each gradation level. In particular, the gamma correction is correction for proper change in the density when the gradation level is changed. When a density deviation occurs over the entire gradation level range, detection of a characteristic change of the density in each gradation level is difficult. Thus, when the gamma correction is executed, the developing bias correction is executed before execution of the gamma correction.

The execution condition of the displacement correction may be satisfied independently. In a case where the density of each mark has the deviation, even if the marks are formed on the same image forming position, a variation occurs in the amount of light received by the mark sensor 25. Thus, a deviation occurs in the detection position of the mark, making it difficult to detect the image forming position with accuracy. Therefore, when the execution conditions of both the displacement correction and the developing bias correction are met, the developing bias correction is executed prior to the displacement correction.

When a non-agitation period of the printer 100 is long, unevenness is highly likely to occur in a toner charging amount, which may cause unevenness in the density. Here, a non-agitation period is a period during which the agitator 71 does not agitate the toner. For example, when the printer 100 is shipped with the toner accommodating portion 70 previously set therein, the toner in the toner accommodating portion 70 may be exposed to an external air during a storage period after production of the printer 100. In particular, when the storage period of the printer 100 after production is long, the toner tends to aggregate. Therefore, when the printer 100 is operated for the first time after shipment, unevenness is highly likely to occur in the charging state of the toner. When the printing operation is performed using the toner in which unevenness occurs in the charging amount, image quality may be deteriorated due to density unevenness. Therefore, when the printer 100 is operated for the first time after shipment, or when the printing operation is performed after a long interval from the previous printing operation, agitation of the toner needs to be performed for a long period of time so as to reliably stabilize the toner charging state.

When the printer 100 of the present embodiment determines that the non-agitation period is long upon in response to the print job execution instruction, the execution condition of the density correction is satisfied. Then, before the print job, the printer 100 executes the density correction after agitating the toner for not so long time. However, when the density correction marks are formed in a state where the toner charging amount is unstable, the densities of the formed marks themselves may be unstable. When the densities of the formed marks are unstable, correction values determined on the basis of the marks have low reliability. Further, when the marks for other correction process are formed on the basis of the low-reliable correction values, reliability of the other correction process becomes low.

Thus, when determining that the non-agitation period is long, the printer 100 of the embodiment executes twice the formation process of the density correction marks to acquire mark data (first mark data and second mark data) corresponding to two executions of the mark formation. Specifically, in this case, the printer 100 executes "formation of marks", "acquisition of mark data", "agitation of toner", "formation of marks", "acquisition of mark data" in this order. The toner is also agitated during formation of the marks. Then, the printer 100 calculates a difference between the first and second mark data and determines whether or not the difference falls within an allowable range.

When the agitation of the toner is insufficient in the first mark formation, a charging state of the toner is brought close to a more stable state by the agitation performed until start of the second mark formation, so that the difference between the first and second mark data tends to be large. That is, when the difference between the first and second mark data is large, it can be estimated that agitation of the toner is insufficient at least in the first mark formation. That is, in this case, the toner charging state is highly likely to be unstable.

On the other hand, when the toner charging state is stable, the difference between the toner charging amounts in two mark-formation processes is small. That is, when the difference between the first and second mark data is small, it can be estimated that the toner charging state is stable and that the acquired mark data is highly reliable. Thus, when the difference between the first and second mark data is not large, the printer 100 uses the acquired mark data to determine a correction value for the density correction.

Figure 7:
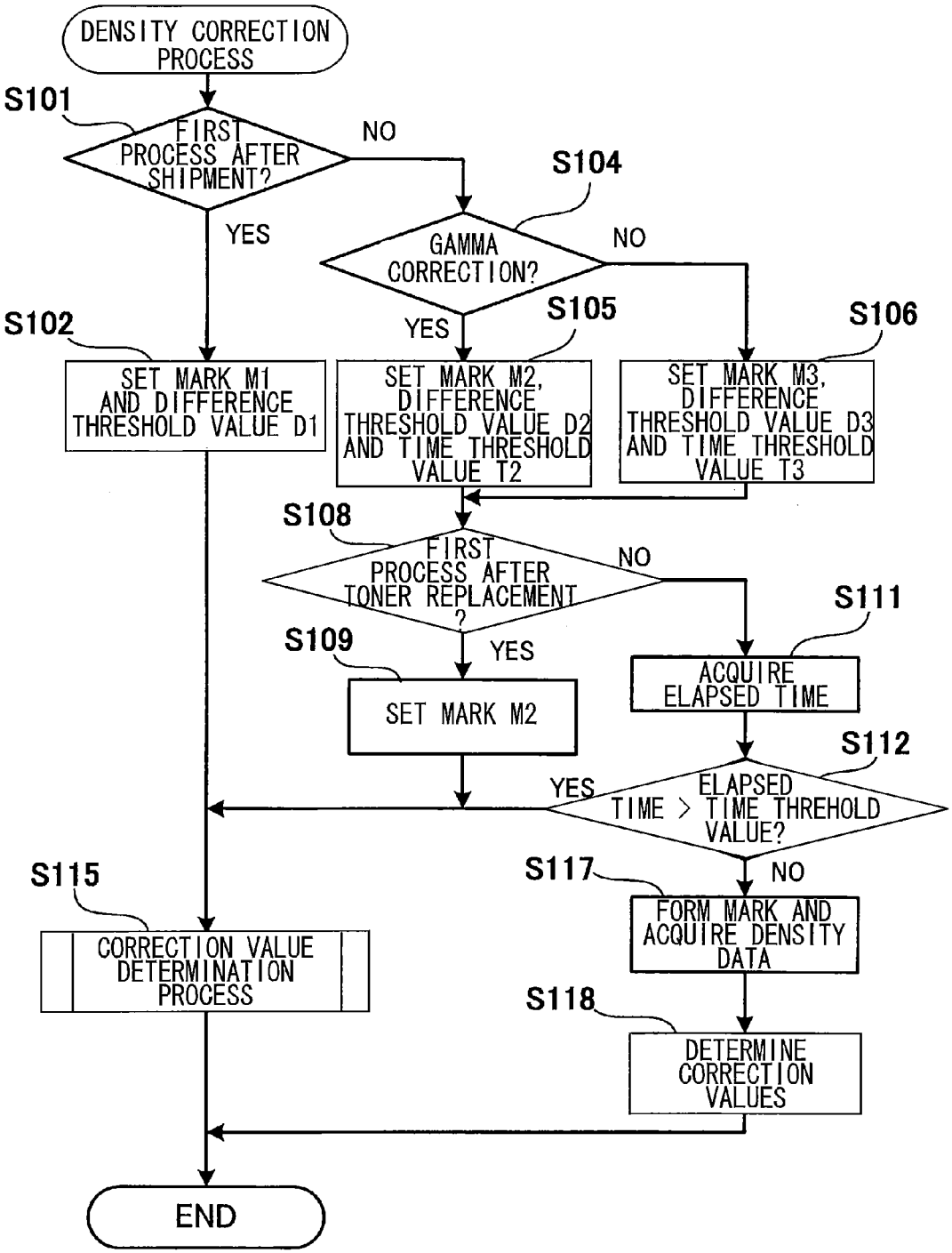
FIG. 7 is a flowchart illustrating a density correction process.

The followings describe the density correction process performed in the printer 100 with reference to a flowchart of FIG. 7. The density correction process determines at least one correction value for the density correction. The density correction process is the developing bias correction, for example, and executed by the CPU 31 when the printer 100 receives the print job in a state where the execution condition of the correction process is satisfied.

In the density correction process, the printer 100 determines whether the non-agitation period is long. Examples of cases where the non-agitation period is long include a case where the current correction process is the first correction process after shipment of the printer 100, a case where the current correction process is the first correction process after at least one toner accommodating portion 70 is replaced with new one, and a case where an elapsed time after execution of the previous correction process is long (in other words, the elapsed time is longer than a threshold time).

Thus, in the density correction process, in S101, the printer 100 first determines whether the current correction process is the first correction process after shipment of the printer 100. The printer 100 can determine whether the current correction process is the first correction process after shipment of the printer 100 by referring to a value of a flag which is set to ON upon execution of the correction process. In this case, the printer 100 is configured to store the flag value in the NVRAM 34 and is shipped with the flag set to OFF. The printer 100 sets the flag to ON after execution of the correction process. That is, the flag values before and after execution of the correction process are different. Therefore, the printer 100 can determine, on the basis of the flag value stored in the NVRAM 34, whether the printer 100 itself has performed the first correction process after shipment of the printer 100. The NVRAM 34 that stores the flag is an example of an data storage unit.

When the printer 100 determines that the current correction process is the first correction process after shipment of the printer 100 (S101: YES), in S102 the printer 100 sets a type of the mark to be formed to a mark M1, and sets a difference threshold value (described later) to a difference threshold value D1 having the narrowest allowable range. Here, a largest sampling number is set on the basis of the mark M1. Then, the printer 100 executes a correction value determination process which is a process performed when the non-agitation period is determined to be long. Details of the correction value determination process will be described later.

Figure 8:
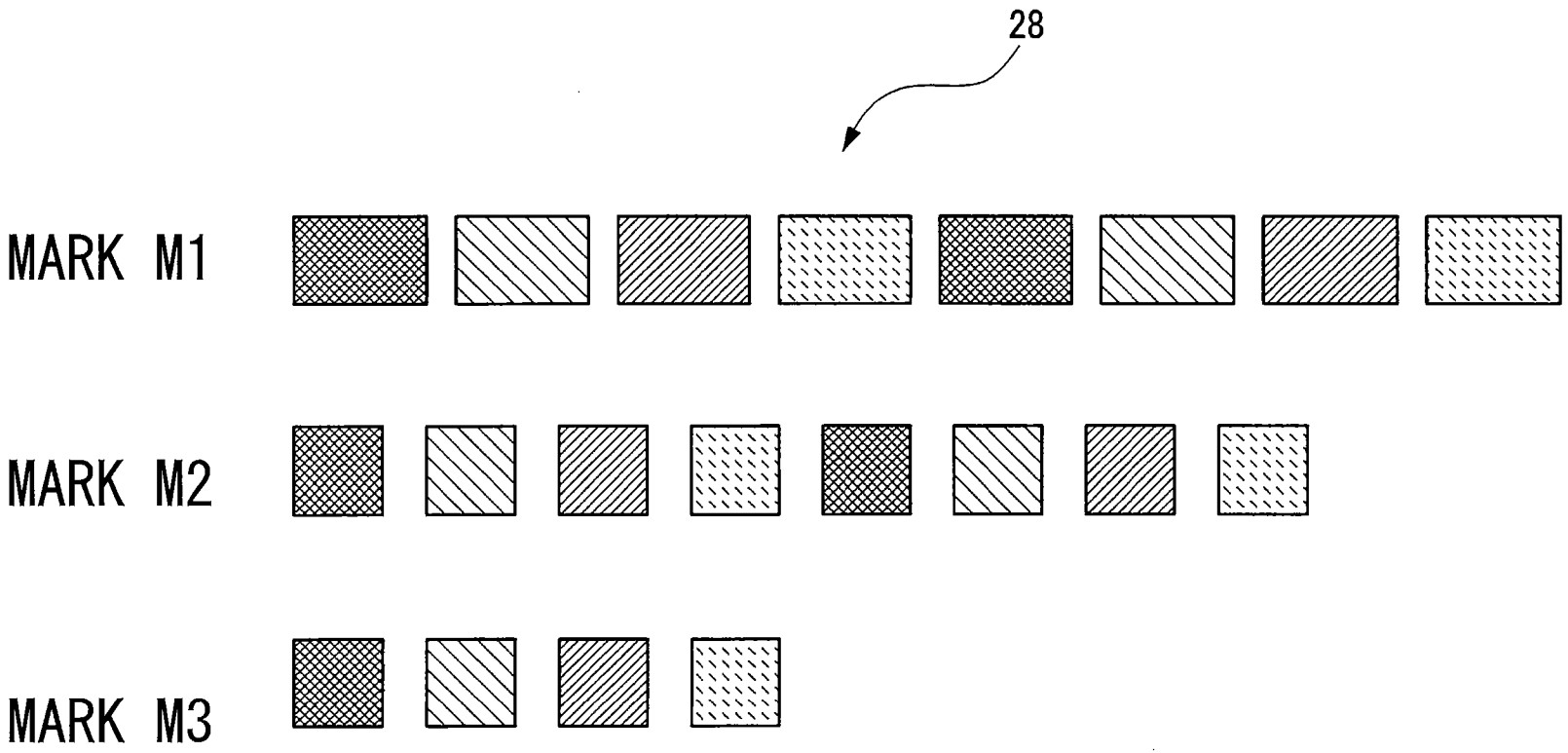
FIG. 8 is an example of density correction marks.

The printer 100 has, as the density correction mark 28, a plurality of types of marks, such as marks M1, marks M2, and marks M3 shown in FIG. 8, among which the sampling numbers are different. In the density correction process, the larger a size of each mark, and the larger the number of the marks, the larger the sampling number. That is, the size of each mark M1 is large, and the number of the marks M1 is large. That is, the size of the mark M1 is larger than the size of the Mark M2 and the size of the mark M3. The number of the marks M1 is equal to the number of the marks M2. The sampling number obtained from the marks M1 is largest among the three types. Thus, the mark M1 is used when required accuracy is highest. The size of each mark M2 is the same as that of the mark M3, but the number of marks M2 is larger than that of the marks M3, so that the sampling number obtained from the marks M2 is smaller than that for the marks M1 and larger than that for the marks M3. The sampling number obtained from the marks M3 is smallest among the three types.

The sampling number is doubled when the size of each mark is doubled. The sampling number is also doubled when the number of marks is doubled without changing the size. However, like the mark M2, by doubling the number of the marks by repeating the marks of respective colors, influence, such as eccentricity of the photosensitive body 1 or the conveying belt 7, can be eliminated more effectively than in the case where the size of each mark is doubled.

The difference threshold value defines an allowable range of the difference between the first and second mark data. Here, it can be determined that the toner charging state is stable when the difference is within the allowable range. As described above, the printer 100 executes twice the formation process of the density correction marks to acquire the first and second mark data. In this case, when the difference between the first and second mark data is smaller than the difference threshold value, the printer 100 determines that the difference is small. The smaller the difference threshold value, the narrower the allowable range. The difference threshold value D1 is smaller than other difference threshold values D2 and D3 to be described later.

The difference threshold value may be common for all colors. Alternatively, difference threshold values may be used for the respective colors. When the difference threshold values are different among the respective colors, the printer 100 stores the difference threshold values for respective colors and use the difference threshold value corresponding to the color of the mark subject to the determination. In the printer 100, the difference threshold values are previously determined for the colors according to spectral reflectance characteristics of the toner, sensitivity of the mark sensor 25, and conspicuousness of the density unevenness. The determined difference threshold values are stored in the ROM 32 or NVRAM 34. The difference threshold value is an example of an upper limit of the allowable range in difference determination process.

When the printer 100 determines that the current correction process is not the first correction process performed after shipment of the printer 100 (S101: NO), in S104 the printer 100 determines whether the execution condition of the gamma correction is satisfied. As described above, when the execution condition of the density correction (that is the developing bias correction in this embodiment) is satisfied, the execution condition of the gamma correction may also be satisfied. When the execution condition of the gamma correction is satisfied, high accuracy is required for the density correction in order to ensure accuracy of the gamma correction.

When the printer 100 determines that the execution condition of the gamma correction is satisfied (S104: YES), in S105 the printer 100 sets the type of the mark 28 to the mark M2, sets the difference threshold value to a difference threshold value D2, and sets a time threshold value to a time threshold value T2. A medium sampling number is set on the basis of the mark M2 and the difference threshold value D2 defines a medium allowable range. The time threshold value is a threshold value to be compared with an elapsed time described later and serves as a criterion for determining whether the non-agitation period is long.

On the other hand, when the printer 100 determines that the execution condition of the gamma correction is not satisfied (S104: NO), in S106 the printer 100 sets the type of the mark 28 to the mark M3, sets the difference threshold value to a difference threshold value D3, and sets the time threshold value to the time threshold value T3. A smallest sampling number is set on the basis of the mark M3. The difference threshold value D3 defines a widest allowable range. The difference threshold values D1, D2, and D3 satisfies D1 D2 D3, and the time threshold values T2 and T3 satisfies T2 T3.

In S108, the printer 100 determines, irrespective of whether or not the execution condition of the gamma correction is satisfied, whether the current correction process is the first correction process after replacement of at least one toner accommodating portion 70 of the developing device 4 with new one. Specifically, the printer 100 checks information stored in the memories 701 of the respective toner accommodating portions 70 illustrated in FIG. 1, and determines, on the basis of the information, whether an image has been formed by using toner of the mounted toner accommodating portion 70. That is, the printer 100 determines whether the current correction process is the first correction process after replacement of the toner accommodating portion 70 with new one.

Each toner accommodating portion 70 is shipped with information indicating that the toner accommodating portion itself is a new one stored in the memory 701. It is determined that the toner accommodating portion 70 is new one when the first correction process using the toner accommodating portion 70 has not yet been executed after the shipment of the toner accommodating portion 70. When the printer 100 detects "close"→"open"→"close" of the cover 15 on the basis of the output signal from the open and close sensor 16, the printer 100 determines that there is a possibility that the toner accommodating portion 70 has been replaced, and reads information from the memory 701. Then, the printer 100 stores the read information in the NVRAM 34, for example. When open and close of the cover 15 is not detected, the printer 100 can determine that the replacement of the toner accommodating portion 70 has not been made, so that it is not necessary to read information from the memory 701 for each print operation. However, there is a possibility that the toner accommodating portion 70 is replaced during power-off time, so that the printer 100 preferably reads the information from the memory 701 for the first correction process after power is turned ON.

The printer 100 acquires information from the NVRAM 34 in S108 and determines whether the current correction process is the first correction process after replacement of the toner accommodating portion 70. Note that, after executing the first correction process using the toner of the toner accommodating portion 70, the printer 100 rewrites the information of both the memory 701 and NVRAM 34 into information indicating that the first correction process has been executed. That is, after execution of the correction process, information indicating that the first correction process has been executed is stored in the memory 701. The memory 701 is an example of a replacement information storage unit.

After the printer 100 determines that the current correction process is the first correction process after replacement of the toner accommodating portion 70 (S108: YES), in S109 the printer 100 sets the mark type to the mark M2. That is, when a new toner accommodating portion 70 exists, the printer 100 sets the sampling number for the mark 28 to a medium number. Then, the printer 100 determines that the non-agitation period is long and executes the correction value determination process described later.

When the printer 100 determines that the current correction process is not the first correction process after replacement of the toner accommodating portion 70 (S108: NO), in S111 the printer 100 acquires an elapsed time after the previous toner agitation. That is, when a new toner accommodating portion 70 does not exist, the printer 100 does not change the sampling number. The elapsed time is, e.g., an elapsed time after execution of the previous correction process, an elapsed time after execution of the previous print operation, or an elapsed time after execution of the previous rotation of the agitator 71. However, in the first correction process after power-on, the printer 100 may use a time period from previous power-off to current power-on as the elapsed time. For example, the printer 100 stores a power-off time at power-off process and acquires the elapsed time from the power-off time and to current power-on time.

In S112, the printer 100 determines whether the acquired elapsed time is longer than the time threshold value set in S105 or S106. As described above, when the execution condition of the gamma correction is satisfied, the time threshold value T2 is used, and the printer 100 determines whether the acquired elapsed time is longer than the time threshold value T2. On the other hand, when the execution condition of the gamma correction is not satisfied, the time threshold value T3 is used, and the printer 100 determines whether the acquired elapsed time is longer than the time threshold value T3. When determining the elapsed time is longer than the time threshold value, the printer 100 determines that the non-agitation period is long, and executes the correction value determination process of S115 described later. The process of S112 is an example of period determination process.

That is, the printer 100 determines that the non-agitation period is long when determining that the current correction process is the first correction process after shipment of the printer 100, when determining that the current correction process is the first correction process after replacement of the toner, or when determining that the elapsed time is long. When the current correction process is the first correction process after shipment of the printer 100, toner aggregation may proceed or agitation to be performed is highly likely to be the first agitation. In this case, the printer 100 assumes that the non-agitation period is long. Further, when a toner agitation state in the toner accommodating portion 70 immediately after the replacement is unknown, the printer 100 assumes that the non-agitation period is long. Further, because the toner stirring is not performed during power-off time, the printer 100 assumes that the non-agitation period is long when the time period from the previous power-off time to the current power-on time is long.

After S102 or S109, or after determining that the elapsed time is longer than the time threshold value (that is, the non-agitation period is long) (S112: YES), in S115 the printer 100 executes the correction value determination process for determining an appropriate correction value.

The type of the mark to be formed and difference threshold value to be used have been determined before start of the correction value determination process. For example, when the current correction process is the first correction process after the shipment of the printer 100, the toner charging state is highly likely to be unstable in all the toner accommodating portions 70. Further, in the first correction process after shipment of the printer 100, the density correction is performed, and subsequently another correction is also performed using the acquired correction value. Thus, in the first correction process after shipment of the printer 100, the printer 100 forms the marks for a large sampling number, and narrows the allowable range, so as to acquire highly reliable correction values.

Further, when the execution condition of the gamma correction is satisfied, the printer 100 executes the gamma correction after the density correction process (the developing bias correction in this embodiment). The gamma correction is lower in execution frequency than other corrections, and the correction value that has been once determined is used for a long time. When the execution condition of the gamma correction is satisfied, the printer 100 forms the marks for a larger sampling number than in a case where the execution condition of the gamma correction is not satisfied and sets a narrower allowable range than the case where the execution condition of the gamma correction is not satisfied, so as to acquire highly reliable correction value for the density correction.

Because the toner charging state is highly likely to be unstable in the toner accommodating portion 70 immediately after replacement of the toner accommodating portion 70, the printer 100 forms the marks for a large sampling number so as to acquire highly reliable correction value for the density correction. When determining that an elapsed time after previous agitation is long, the printer 100 may form the marks having increased sampling number.

Figure 9:
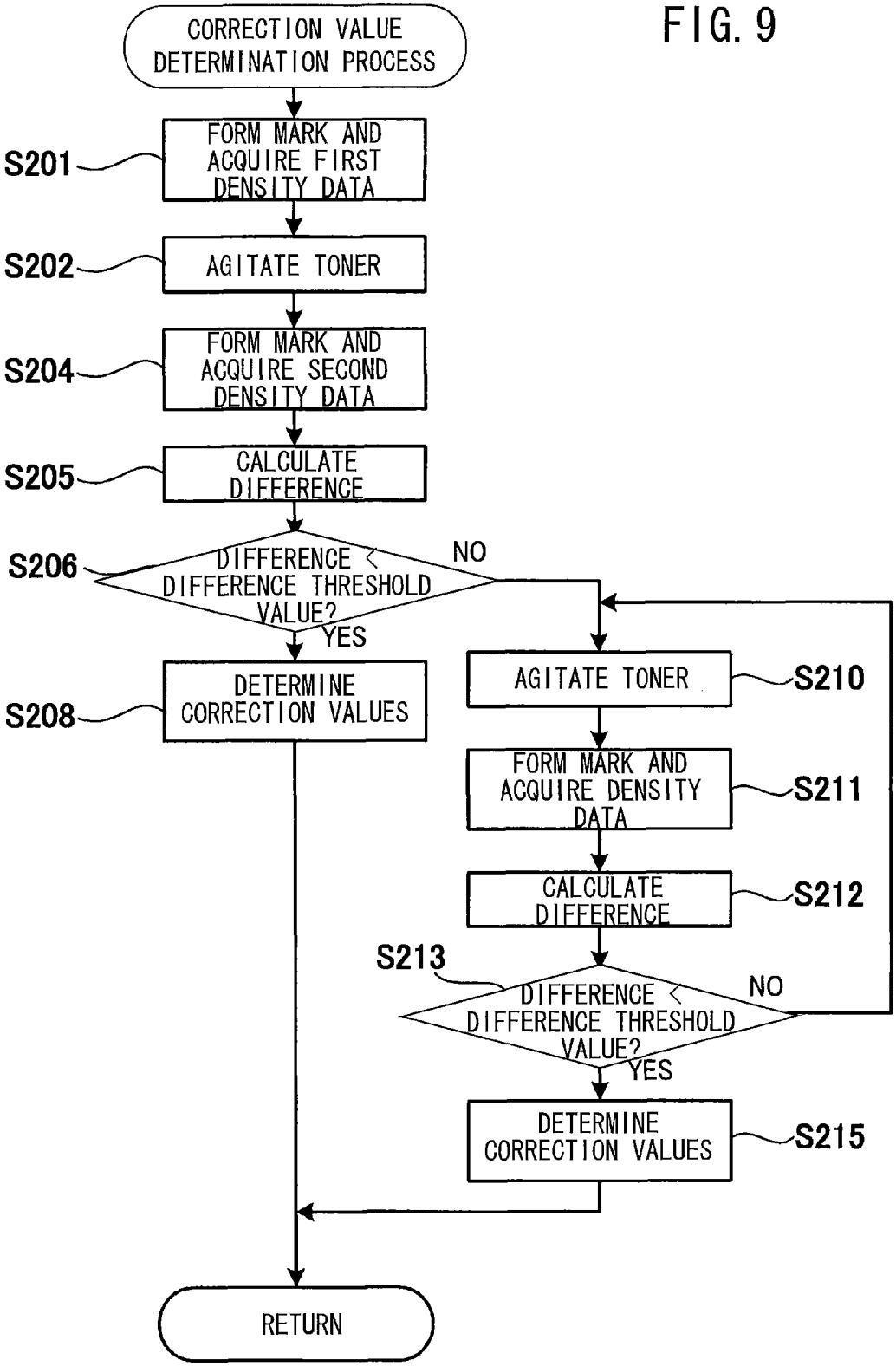
FIG. 9 is a flowchart illustrating a correction value determination process.

A procedure of the correction value determination process will be described with reference to the flowchart of FIG. 9. In the correction value determination process, in S201, the printer 100 executes a formation process of the marks of respective colors and acquisition of the density data for respective colors. That is, even when the non-agitation period is long, the printer 100 executes the formation of the marks in an early stage without providing a special agitation time before the marks are formed in S201. The density data acquired in S201 is the density data acquired first, which is referred to as "first density data".

The printer 100 uses the mark sensor 25 to read a plurality of locations of each mark to acquire a plurality of density values. As described above, the sampling number, which is the number of the density values to be acquired, is different depending on the mark type. The printer 100 then calculates, excluding anomalous values, an average value of the density values. For example, the printer 100 excludes the minimum and maximum density values and calculates the average value of the remaining density values as the density data of the relevant mark.

In S202 the printer 100 then executes toner agitation for a prescribed period of time. Further, in S204 the printer 100 executes, for respective colors, once again the formation process of the marks and acquisition of the density data. In S204, the marks of the same number and size as those in S201 are formed under the same conditions as in S201 and the same number of sampling is executed. That the formation of the marks is performed under the same conditions means that, for example, the same charging bias value, the same developing bias value, and the same exposure intensity are used to form the marks. The density data acquired in S204 is the density data acquired secondarily, which is referred to as "second density data". The process of S201 and S204 is an example of an acquisition process.

In S205, the printer 100 calculates a difference between the first and second density data, that is, a difference between the density value of the first density data and the density value of the second density data for each color. Further, in S206 the printer 100 determines whether the calculated difference is smaller than the difference threshold value for each color. The differential threshold value used here is one of the difference threshold values D1, D2, and D3. The process of S206 is an example of a difference determination process. The printer 100 calculates the difference for each color in S205 and compares the difference of each color with the difference threshold value of a corresponding color.

After determining that the differences of all the colors are smaller than their corresponding difference threshold values (S206: YES), in S208 the printer 100 determines correction values for respective colors on the basis of the second density data, and ends the correction value determination process. The printer 100 stores the determined correction values in the RAM or the NVRAM, for example. When the difference between the first and second density data is small, it can be estimated that the toner charging state is stable and that the acquired mark data is highly reliable. Thus, the printer 100 uses the second density data closer to the present state to determine the correction value. The process of S208 is an example of a determination process.

On the other hand, when determining that there is a color for which the difference is greater than or equal to the difference threshold value (S206: NO), the charging state of the toner of the relevant color may be unstable. Then, in S210 the printer 100 executes, a prescribed period of time, agitation of at least the toner of the color for which the difference is greater than or equal to the difference threshold value. The prescribed period of time for agitation in S210 may be the same as or different from that in S202.

In S211 the printer 100 executes, for the color for which the difference is determined to be greater than or equal to the difference threshold value in S206, once again the formation process of the marks and acquisition of the density data. In S212, the printer 100 calculates, for the color for which the difference is determined to be greater than or equal to the difference threshold value in S206, a difference between the density data acquired this time and previous density data, i.e., the second density data. In S213, the printer 100 determines whether the calculated difference is smaller than the difference threshold value. The process of S213 is an example of a difference redetermination process.

After determining that the difference is smaller than the difference threshold value (S213: YES), in S215 the printer 100 determines a correction value on the basis of the density data acquired this time, and ends the correction value determination process. The printer 100 stores the determined correction value in the RAM or the NVRAM, for example. When the difference between the density data is small, it can be estimated that the toner charging state is stable and highly reliable correction value can be acquired by determining the correction value based on the latest density data. Additional mark formation is not executed for a color for which the difference between the first and second density data is smaller than the difference threshold value and, in this case, the correction value may be determined on the basis of the second density data.

When determining that the difference is not smaller than the difference threshold value even after the additional mark formation (S213: NO), the printer 100 returns to S210 and executes the agitation of the toner, a formation process of the marks 28, and acquisition of the density data. When the difference does not become smaller than the difference threshold value even after the mark formation process and acquisition of the density data (S210-S212) are repeated a prescribed number of times, it is assumed that a certain fault may occur. In this case, the printer 100 may display an error message and stop its operation.

After S208 or S215, the printer 100 returns to the density correction process of FIG. 7. The correction value has been determined in the correction value determination process of S115, so that the printer 100 ends the density correction process.

Returning to FIG. 7, when determining that the elapsed time is shorter than or equal to the time threshold value (S112: NO), in S117 the printer 100 executes once the formation process of the marks 28 and acquisition of the density data. In S118, the printer 100 determines correction values on the basis of the acquired density data and ends the density correction process. The printer 100 stores the determined correction values in the RAM or the NVRAM, for example. The type of the marks to be formed in S117 is the same as that determined in S105 or S106, depending on whether the execution condition of the gamma correction is satisfied. That is, the sampling number is changed depending on determination of whether the gamma correction is executed. The printer 100 stores the correction value determined in S118 in the NVRAM 34 and reads and uses the stored correction value in subsequent image formation.

When the non-agitation period is not long, it can be estimated that the toner is agitated sufficiently and that the toner charging amount is stable. That is, it is highly likely that reliable density data can be acquired by executing the formation process of the marks 28 and acquisition of the density data only once. In this case, the mark formation process is executed only once, so that, as compared with a case where the correction value determination process of S115 is executed, the toner use amount can be reduced, and the correction value can be determined earlier.

As described above in detail, the printer 100 of the embodiment executes twice the formation process of the marks 28 and reading the marks 28 using the mark sensor 25 when determining that the non-agitation period is long. Then, when determining that the difference between the first and second mark data does not exceed the difference threshold value, the printer 100 determines adjusting values (correction values) for image adjustment. When the non-agitation period is long, the toner charging state is highly likely to be unstable. However, when the difference between the first and second mark data is small, it can be estimated that the toner charging state is stable and that reliability of the acquired mark data is high. That is, by determining the adjusting values for image adjustment on the basis of the mark data for which the difference is small, highly reliable adjusting value can be acquired. As a result, both reduction in a printing throughput and reduction in image quality can be suppressed.

The first embodiment may be modified as follows.

In the embodiment, for determining whether the non-agitation period is long, the printer 100 determines: whether the current correction process is the first correction process after shipment of the printer 100 (S101); whether at least one toner accommodating portion 70 is new one (S108); and whether the elapsed time after execution of the previous correction process is long (S112). All of these determinations need not be performed, but, for example, at least one of these determinations may be performed. Further, for example, other criteria may be employed for determining whether the non-agitation period is long.

Further, in the embodiment, replacement of the toner accommodating portion can be made for each color. However, the present disclosure can be applied to a configuration where the toner accommodating portions of all colors are collectively replaced. Further, in the embodiment, the open and close sensor 16 is provided in the cover 15, and when the open state and the closed state of the cover is detected by the open and close sensor 16, the CPU 31 reads the memory 701 of each toner accommodating portion 70. However, the memory 701 may be read irrespective of the open state and the closed state of the cover 15. Further, in S108 of the embodiment, an affirmative determination (YES) is made only when the attached toner accommodating portion 70 is a new one. However, the affirmative determination (S108: YES) may be made when the current correction process is the first correction process after replacement of the toner accommodating portion 70, irrespective of whether the toner accommodating portion 70 is a new one.

Further, the present disclosure can be applied to the printer 100 even when the toner accommodating portion 70 does not have the memory 701. For example, when the printer 100 detects "close"→"open"→"close" of the cover 15 on the basis of the output signal from the open and close sensor 16 of the cover 15, the printer 100 may determine that the toner accommodating portion 70 has been replaced. When the determination is made on the basis of the output signal of the open and close sensor 16, the replaced toner accommodating portion 70 cannot be identified. In this case, the printer 100 may determine that the toner accommodating portions 70 of all the colors have been replaced.

Further, in the embodiment, when at least one new toner accommodating portion exists, the mark formation process for all the colors is executed twice. However, the mark formation process may be executed twice for only the toner of the new toner accommodating portion. That is, the period determination process determining whether the non-agitation period is long may be executed for each color and the difference determination process determining whether the difference is within the allowable range) may be executed for each color.

Further, the sampling number for the marks 28 is increased, for example, when the current correction process is the first correction process after shipment of the printer 100, when the execution condition of the gamma correction is satisfied, or when the current correction process is the first correction process after replacement of the toner accommodating portion 70. However, the sampling number need not always be increased. That is, the same marks 28 as those for a case other than the above cases are used to acquire the first and second mark data, and the printer 100 determines whether a difference between the first and second mark data falls within the allowable range. Even with this procedure, the adjusting value for image adjustment can be determined with high accuracy. Further, in the embodiment, each of the difference threshold value and the time threshold value is changed depending on whether the execution condition of the gamma correction is satisfied. However, the difference threshold value and the time threshold value may not be changed, or only one of them may be changed.

Further, the information to be stored in the flag of the NVRAM 34 or information to be stored in the memory 701 of the toner accommodating portion 70 may be information to be written when executing the correction process or information to be deleted when executing the first correction process, for example. Alternatively, the information may be the number of times of execution of the correction process or information related to an agitation amount of the toner by the agitator 71.

Further, for example, when a time period from the previous power-off to current power-on is unclear, the elapsed time may be determined to be long.

Further, when it is known that an execution ratio of monochrome image print performed in the printer 100 is higher than the color image print, the difference threshold value may be increased for the colors other than black to widen the allowable range therefor.

Further, in the embodiment, when the execution conditions of the plurality of correction process are satisfied, the developing bias correction is preferentially executed, and the present disclosure is applied to the developing bias correction (that is, during the density correction process, the developing bias correction is executed in the embodiment). However, the present disclosure is not limited to this, but another correction process may be executed preferentially. In this case, the present disclosure may be applied to the correction process to be executed preferentially.

Next, a printer 100 according to a second embodiment will be described, wherein like parts and components are designated with the same reference numerals to avoid duplicating description.

There is known a technology in which, in a system including an image forming apparatus and an external apparatus such as a personal computer (PC) connected to the image forming apparatus. The image forming apparatus forms a pattern image for correction. The external apparatus corrects an image to be printed on the basis of correction data acquired from the pattern image. The image forming apparatus performs printing on the basis of a corrected image.

For example, Japanese Patent Application Publication No. 11-252386 discloses the above-mentioned system. More specifically, Japanese Patent Application Publication No. 11-252386 discloses a system including a printer, a PC, and a calibration curve creating apparatus. The printer outputs a pattern image for correction. The calibration curve creating apparatus generates correction data on the basis of a result of reading the pattern image and transmits the generated correction data to the PC. The PC uses the correction data to correct an image to be printed.

However, this technology has the following problem. When the pattern image is generated in a state where a charged state of toner is unstable, the correction data acquired from the pattern image has lower reliability. When such correction data having low reliability is used to correct an image, satisfactory image quality may not be obtained.

The present disclosure also can solve this problem. That is, one of an objects of the present disclosure is to provide a technology capable of suppressing reduction in image quality in a system that uses correction data on the basis of a result of reading a pattern image formed in an image forming apparatus to correct an image to be printed.

In the second embodiment, the printer 100 is connected to a PC 200 through the communication IF 37. The PC 200 has a printer driver installed therein, which is adapted to the printer 100, and transmits print data to the printer 100. The printer 100 receives the print data from the PC 200 and executes a printing operation based on the received data. A plurality of PCs 200 may be connected to one printer 100, or a plurality of printers 100 may be connected to one PC 200. The PC 200 includes a nonvolatile storage device 201, such as an HDD or an NVRAM.

Figure 10:
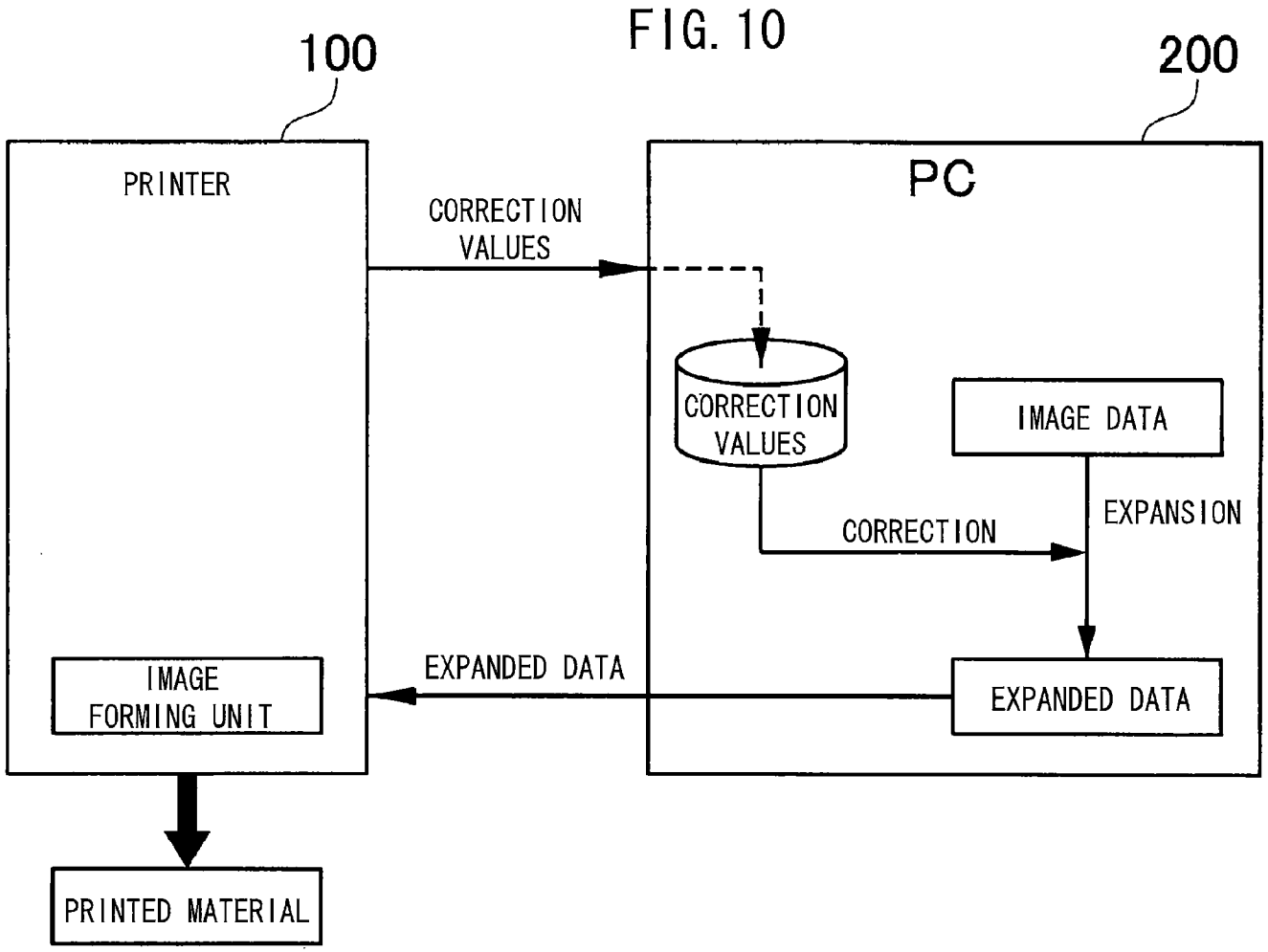
FIG. 10 is an explanatory diagram illustrating procedures of print operation according to a second embodiment.

The printer 100 receives a print execution instruction from the PC 200. As illustrated in FIG. 10, the PC 200 expands an image to be printed to generate a bit-map expanded data and transmits the generated expanded data to the printer 100. The printer 100 receives the expanded data from the PC 200 and executes the printing operation based on the expanded data.

When expanding the image, the PC 200 executes various image corrections for bringing a print result as close as possible to a target image. For performing the image correction, the PC 200 requires the printer 100 connected thereto to transmit various correction values. The printer 100 executes a process for acquiring the correction values and transmits the acquired correction values to the PC 200. The PC 200 is configured to receive the various correction values from each printer connected thereto and store the received correction values in the storage device 201 in association with each printer. The process for acquiring the correction values will be described later.

Upon reception of the print instruction, the PC 200 reads, from the storage device 201, the correction values corresponding to the printer 100 to perform the printing operation, and generates the expanded data reflecting the image correction based on the correction values. In a case where the correction values of the printer 100 to perform the printing operation are not stored in the storage device 201, in such a case where a new printer 100 is connected to the PC 200, the PC 200 requires the printer 100 to transmit thereto the correction values before transmitting a print job and stores the received correction values in the storage device 201.

The image correction includes, for example, the displacement correction, a density correction, and a density gradation correction. When generating expanded data that has been subjected to density gradation correction, the PC 200 receives, as the correction values, a table indicating a relationship between each density gradation of an original image and a corresponding density gradation of an image after correction and stores the table therein. Then, the PC 200 corrects a density value of each point in the image to be printed on the basis of the table and generates the expanded data based on the corrected density value.

The following describes the various correction process to be performed by the printer 100 according to the second embodiment. The printer 100 of the second embodiment executes correction process of acquiring correction values to be used respectively for the displacement correction, the density correction, and the density gradation correction. Note that these correction process are merely examples but not limited thereto. Here, the density correction according to the second embodiment is different from the density correction according to the first embodiment. That is, according to the first embodiment, the density correction includes the developing bias correction and the gamma correction. On the other hand, according to the second embodiment, the density correction is a correction for a value of developing bias or a value of values of exposure bias.

The displacement correction is the same as that of the first embodiment, and thus the detailed explanation is omitted.

The density correction is a process for acquiring a correction value for adjusting a deviation between an ideal density prescribed in the printer 100 and a density of the actually formed mark. As illustrated in FIG. 5, in the density correction, the printer 100 forms the marks 28K, 28C, 28M, and 28Y of respective colors each having a density of 100%. The printer 100 reads the marks 28 by the mark sensor 25 and acquires density data by calculating a current density based on a light receiving amount. Then, the printer 100 acquires a density correction value for bringing the current density close to a target density. The density correction value is an example of a pattern for density correction.

The printer 100 uses a linear function to approximate a relationship between the target density of the mark 28 and a density acquired based on an output from the mark sensor 25 and calculates an adjusting amount of values of an image from a difference between a current density and target density. The printer 100 then acquires an adjusting amount corresponding to the target density as the correction value for the density correction and transmits the acquired adjusting amount to the PC 200. The PC 200 corrects the density of an image to be printed based on the received correction value to generate expanded data. Since the printer 100 performs the printing operation on the basis of the expanded data received from the PC 200, the density of the resultant image is close to the target density.

The printer 100 can correct the image density by correcting a developing bias value or an exposure bias value. That is, the printer 100 may acquire a correction value for the developing bias value or the exposure bias value from a difference between the target density and density of the formed mark and transmit the correction value to the PC 200. The PC 200 transmits the correction value to the printer 100, which performs the printing operation, so that the printer 100 executes the correction processes based on the correction value before performing the printing operation.

The density correction includes the gamma correction explained in the first embodiment, for example.

The printer 100 uses the mark sensor 25 to read the formed mark 29 and calculates an actual density based on a light receiving amount to acquire density data. Further, the printer 100 identifies a change characteristic of the density of each color based on a relative relationship among the densities of the marks. Then, the printer 100 creates, as the correction value, a relative relationship table between the change characteristic and the designated density gradation from the external computer (PC 200, for example). The mark for density gradation correction is an example of the pattern image for correction.

The printer 100 forms the developing bias correction marks 28 and gamma correction marks 29 at one of read positions of the mark sensors 25R and 25L with respect to the widthwise direction. Although these marks may be formed at both reading positions of the mark sensors 25R and 25L in the widthwise direction, they are preferably formed at one of the reading positions of the mark sensors 25R and 25L in the widthwise direction in order to acquire proper mark data while suppressing a use amount of the toner.

In the printer 100 according the second embodiment, a plurality of execution conditions are set for each correction process. The execution conditions include the following conditions, for example: a condition that the current correction process is the first correction process after shipment of the printer 100; a condition that there is the transmission request of the correction value from the PC 200; a condition that the cover is open and then closed; a condition that the toner accommodating portion 70 is replaced; a condition that the printer 100 is powered-on; a condition that an instruction from a user is input; a condition that the number of printed sheets is larger than a prescribed number of sheets; a condition that a rotating amount of the agitator 71 is larger than a prescribed threshold value; a condition that a continuous activation time is longer than a prescribed threshold value; and a condition that a change in an environment, such as, humidity or temperature is occurred. The execution condition may be any combination of the above described condition.

The printer 100 determines whether the execution conditions of each correction process are satisfied. When determining that any execution condition is satisfied, the printer 100 executes a correction process for which the execution condition is satisfied. The printer 100 executes the correction process and acquires the correction values and, thereafter, notifies the PC 200 of information indicating that the printer 100 is ready to transmit the correction values. Then, upon reception of a transmission request of the correction value from the PC 200, the printer 100 transmits the acquired correction value to the PC 200.

As described above, when the agitation of the toner is not performed for a long time, the toner charging state is highly likely to be unstable, which may cause density unevenness of the formed image. In this state, even if the execution conditions of the correction process is satisfied, and the pattern image for correction is formed, reliability of the pattern image itself is low. On the other hand, when the agitation of the toner is performed for a sufficient time every time the execution condition of the correction process is satisfied, a required time for the correction process disadvantageously increases, which may promote toner degradation.

When the execution condition of the correction process is satisfied, the printer 100 determines whether possibility of the density unevenness is high and whether a highly reliable correction values are required. Then, upon determining that possibility of the density unevenness is high or upon determining that a highly reliable correction values are required, the printer 100 executes twice both a formation process of the pattern image (the marks) and a reading process of the formed pattern image (the formed marks). The printer 100 determines that the possibility of the density unevenness is high, when at least one of a condition that the current correction process is the first correction process after shipment of the printer 100, a condition that the current correction process is the first correction process after the printer 100 is powered-on, and a condition that the current correction process is the first correction process after replacement of the toner accommodating portion 70, for example. The printer 100 determines that a highly reliable correction values are required, when the execution condition of the gamma correction is satisfied, for example.

The printer 100 agitates the toner during the pattern formation process. The printer 100 performs twice the pattern formation process. When a difference between two first and second reading results falls within an allowable range, the printer 100 transmits at least one correction value based on the reading result to the PC 200. For example, when the execution conditions of the correction process is satisfied in a state where the toner charging state is unstable, the difference becomes large due to a change in the toner charging state between the first and second pattern formation processes. This is because the toner agitation state becomes more stable at the second pattern formation than the first pattern formation by progress in the agitation of the toner.

That is, by determining whether the difference between two first and second reading results falls within an allowable range, the printer 100 can determine whether the correction value is highly reliable. When the difference is large, reliability of the correction value acquired from the patter formation is not high. On the other hand, when the difference is not large, it can be estimated that a large change does not occur between the two first and second reading results and that the toner charging state is stable in both the first and second pattern formations. That is, it can be estimated that the toner charging state is satisfactorily stable.

Figure 11:
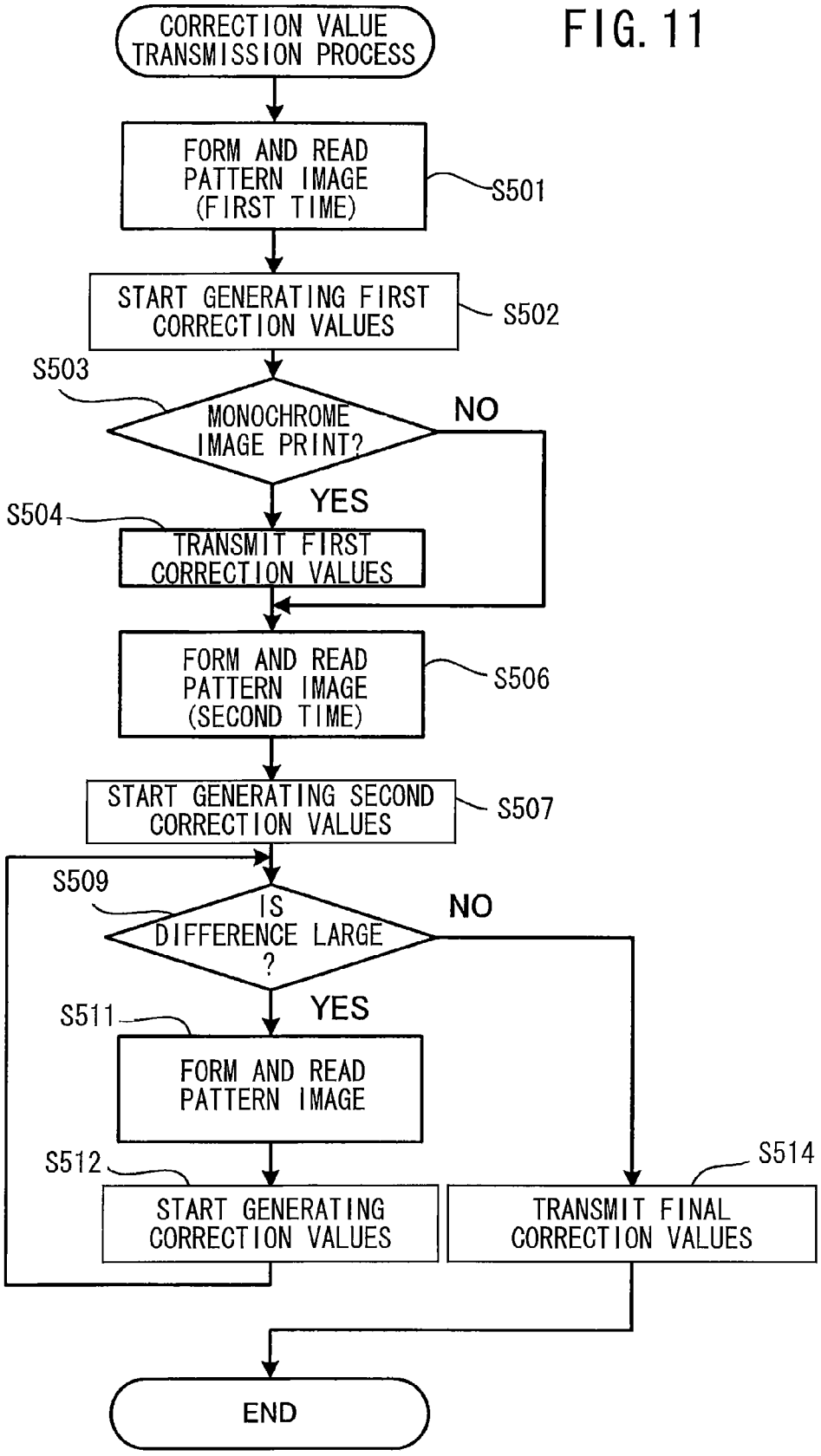
FIG. 11 is a flowchart illustrating a correction value transmission process according to the second embodiment.

A correction value transmission process will be explained with reference to a flowchart shown in FIG. 11. The correction value transmission process is an operation to transmit the correction value. The correction value transmission process is executed by the CPU 31 when the execution condition of the correction process is satisfied.

The printer 100 transmits density gradation correction values to the PC 200 among the above-mentioned various correction values so that the PC 200 executes the density gradation correction. On the other hand, the printer 100 stores therein a displacement correction value and a density correction value and executes therein the displacement correction and the density correction. That is, the correction value transmission process illustrated in FIG. 11 is a process for transmitting the density gradation correction values from among the correction values to the PC 200.

In the correction value transmission process, in S501 the printer 100 executes both a first formation process of the pattern image and the reading process of the formed pattern image. The process S501 is an example of the pattern formation process and a pattern reading process. As described above, the pattern image differs depending on the type of the correction process. The printer 100 forms the mark 29 illustrated in FIG. 6 as the pattern image for the density gradation correction on the conveying belt 7. The printer 100 acquires a reading result of the formed pattern image based on an output signal from the mark sensor 25. The reading result indicates a density of a mark 29 for each color and each density gradation.

In S502, the printer 100 starts generating the correction values based on the reading result of the pattern image. The process S502 is an example of a generation process. The correction value generated in S502 is correction values based on the first pattern image and is thus referred to as "first correction values".

In S503, the printer 100 determines whether the printer 100 receives a transmission instruction of the correction value from the PC 200 and whether the transmission instruction is based on a monochrome image print instruction. That is, the printer 100 determines whether the printer 100 receives, from the PC 200, a notification indicating that a print job of the monochrome image will be transmitted after reception of the correction values.

Upon determining that the transmission instruction is based on the monochrome image print instruction (S503: YES), in S504 the printer 100 transmits the first correction values, which the printer 100 starts generating in S502, to the PC 200. The process S504 is an example of an early transmission process. That is, if the correction value transmission instruction is received from the PC 200 after completion of both the first formation process of the first pattern image and the reading process of the formed first pattern image and before start of the second formation process of the second pattern image and the reading process of the formed second pattern image, the printer 100 transmits the correction values based on the reading result of the first pattern image.

In particular, when determining that the transmission instruction of the correction value received from the PC 200 is based on the monochrome image print instruction, the printer 100 gives preference to early end of printing over correction accuracy. For example, in a monochrome text image, a printing density is often either 0% or 100%, so that it can be estimated that there is a low possibility that an intermediate density gradation level is used. That is, because the density gradation correction is a density correction including the intermediate density gradation level, there is a high possibility that correction values for the density gradation correction is not necessary. Further, when the monochrome print is designated in the print instruction, displacement correction between colors is not necessary. Thus, when determining that the transmission instruction of the correction values is based on the monochrome image print instruction, the printer 100 transmits the first correction values prior to the process of enhancing the reliability of the correction value.

On the other hand, when determining that the transmission instruction of the correction value is not based on the monochrome image print instruction (S503: NO), the printer 100 does not transmit the first correction values. For example, a color shift or a deviation in the density gradation may be noticeable in a color image. Thus, when determining that the transmission instruction of the correction value is based on a color image print instruction, the printer 100 gives preference to acquisition of highly reliable correction values. The printer 100 will transmit the acquired highly reliable correction values if acquired. Further, when determining that the transmission instruction is not based on a monochrome image print instruction, immediate response is not needed and the printer 100 first acquires highly reliable correction values and transmits the acquired correction values. That is, when determining that the transmission instruction of the correction values is not based on the monochrome image print instruction, the printer 100 does not execute the early transmission process.

In S506, the printer 100 executes both a second formation process of the second pattern image and the reading process of the formed second pattern image. The process S506 is also an example of the pattern formation process and the pattern reading process. In S506, the pattern images of the same number and shape as those in S501 are formed under the same formation conditions as in S501. That is, in S506, for example, the same charging bias value, the same developing bias value, and the same exposure intensity as those used in S501 are used to form the marks 29 once again.

In S507, the printer 100 starts generating a correction values based on the second reading result. The process S507 is also an example of the generation process. The correction values generated in S507 are correction values based on the second pattern image and is thus referred to as "second correction values". Note that a start timing of S506 may be at least after completion of S501, that is, may be during execution of S502 or S504.

In S509, the printer 100 calculates a difference between the first correction value generated in S502 and second correction value generated in S507 for each density and each color and determines whether each of the differences is large. The process of S509 is an example of determination processing. For example, the printer 100 determines whether there is, among the differences calculated for each density and each color, a difference larger than a prescribed corresponding difference threshold value. For example, the printer 100 calculates a difference between the first correction value corresponding to 20% density of black and the second correction value corresponding to 20% density of black, and compares the calculated difference with a difference threshold value corresponding to 20% density of black. Further, the printer 100 calculates a difference between the first correction value corresponding to 40% density of yellow and the second correction value corresponding to 40% density of yellow, and compares the calculated difference with a difference threshold value corresponding to 40% density of yellow.

That is, the printer 100 generates the first and second correction values for each density and each color or each combination of colors (for example, color defined by combination of color values represented in CMYK color space) and in S509 compares the difference and the difference threshold value for each density and each color or each combination of colors. The difference threshold value is prepared for each density and each color or each combination of colors and may be different for each density and each color or each combination of colors.

Upon determining that at least one difference among the differences calculated for each density and each color is large (S509: YES), in S511 the printer 100 executes once again both the formation process of the pattern image and the reading process of the formed pattern image. In S511, only the pattern image of a color or a density for which the difference has been determined to be large may be formed. For example, when the difference between the first and second correction values for 20% density of black is larger than the difference threshold value for black corresponding to 20% density of black, the printer 100 determines YES in step S509 even if differences for other pattern images are not large. Then, in S511, the printer 100 forms only the mark 291K that corresponds to 20% density of black. That is, the printer 100 does not form the mark of a color and a density for which the difference has been determined not to be large.

For the mark for which the difference has been determined to be small, the printer 100 adopts one of the first and second correction values as a highly reliable correction value. Then, the printer 100 forms only the pattern image for which the difference has been determined to be large, so that a toner use amount and a time required for acquiring the correction value can be saved.

In S512, the printer 100 starts generating the correction value based on the reading result acquired in S511. After completion of generation of the correction values, the printer 100 returns to S509, and compares the current correction value calculated in S512 with the previous correction value in order to determine whether the difference between them is large. For example, in the above example, the printer 100 forms and reads the mark 291K for 20% density of black, so in S512, the printer 100 generates only the correction value for 20% density of black based on the reading result. Then, in S509, the printer 100 compares the correction value for 20% density of black generated in S512 with the previous correction value for 20% density of black. In this case, the previous correction value for 20% density of black is included in the second correction values generated in S507.

On the other hand, upon determining that the difference is not large (S509: NO), in S514 the printer 100 transmits the final (latest) correction values to the PC 200. The process S514 is an example of a transmission process. The correction values to be transmitted to the PC 200 are an example of data to be transmitted. Each final correction value is a most recently generated correction value. For example, when in S509 executed in first time determining that the differences between the first and second correction values are not large, in S514 the printer 100 transmits the second correction values.

On the other hand, as in the above example, when determining that the difference between the first and second correction values for 20% density of black is large, additionally forming and reading the mark 291K, and determining that the difference between the additional correction value for 20% density of black generated on the basis of the reading result and the second correction value is not large, the printer 100 transmits the additional correction value as the correction value for 20% density of black. Note that the printer 100 transmits the second correction values as the correction values for the colors and densities other than that of the mark 291K of 20% density of black.

Further, when determining in S509 that a difference between the additional correction value and the second correction value is large (S509: YES), in S511 the printer 100 executes once again both the formation process of the mark and the reading process of the formed mark, and in S512 generates a correction value. Then, the printer 100 compares the second additional correction value currently generated in S512 with the previous additional correction value. When determining that the difference between the above two correction values is not large, the printer 100 transmits the second additional correction value to the PC 200.

In S514, the printer 100 may notify the PC 200 of information indicating that preparation of the correction values has been made, and transmit the correction values after receiving the transmission request from the PC 200. The printer 100 ends the correction value transmission process after transmission of the correction values.

As described above in detail, the printer 100 of the second embodiment executes twice both the formation process of the pattern image and the reading process of the formed image, and determines whether the difference between data related to the reading results of the first and second pattern images falls within an allowable range. Then, upon determining that the difference falls within the allowable range, the printer 100 transmits, to the PC 200, data based on at least one of the first and second reading results. When the toner charging state is unstable, the difference between the first and second reading results tends to be large. When the difference between the first and second reading results is small, it can be estimated that the toner charging state is satisfactorily stable. That is, when determining that a highly reliable correction value has been obtained, the printer 100 transmits the data related to the reading result of the pattern image, so that reduction in image quality can be suppressed in a system that corrects an image to be printed using the data related to the reading result of the pattern image.

The second embodiment may be modified as follows.

In the second embodiment, the correction values are generated in the printer 100. However, the correction values may be generated in the PC 200. For example, the following procedure may be employed. That is, in S509, the printer 100 determines whether a difference between output signals of the mark sensor 25 or a difference between density (or density data) based on the output signals of the mark sensor 25 is large. Then, when determining that the difference is not large, the printer 100 transmits the output signal of the mark sensor 25 or density (or density data) based on the output signal of the mark sensor 25 to the PC 200. The PC 200 generates correction values from the received data and stores the correction values therein.

Figure 12:
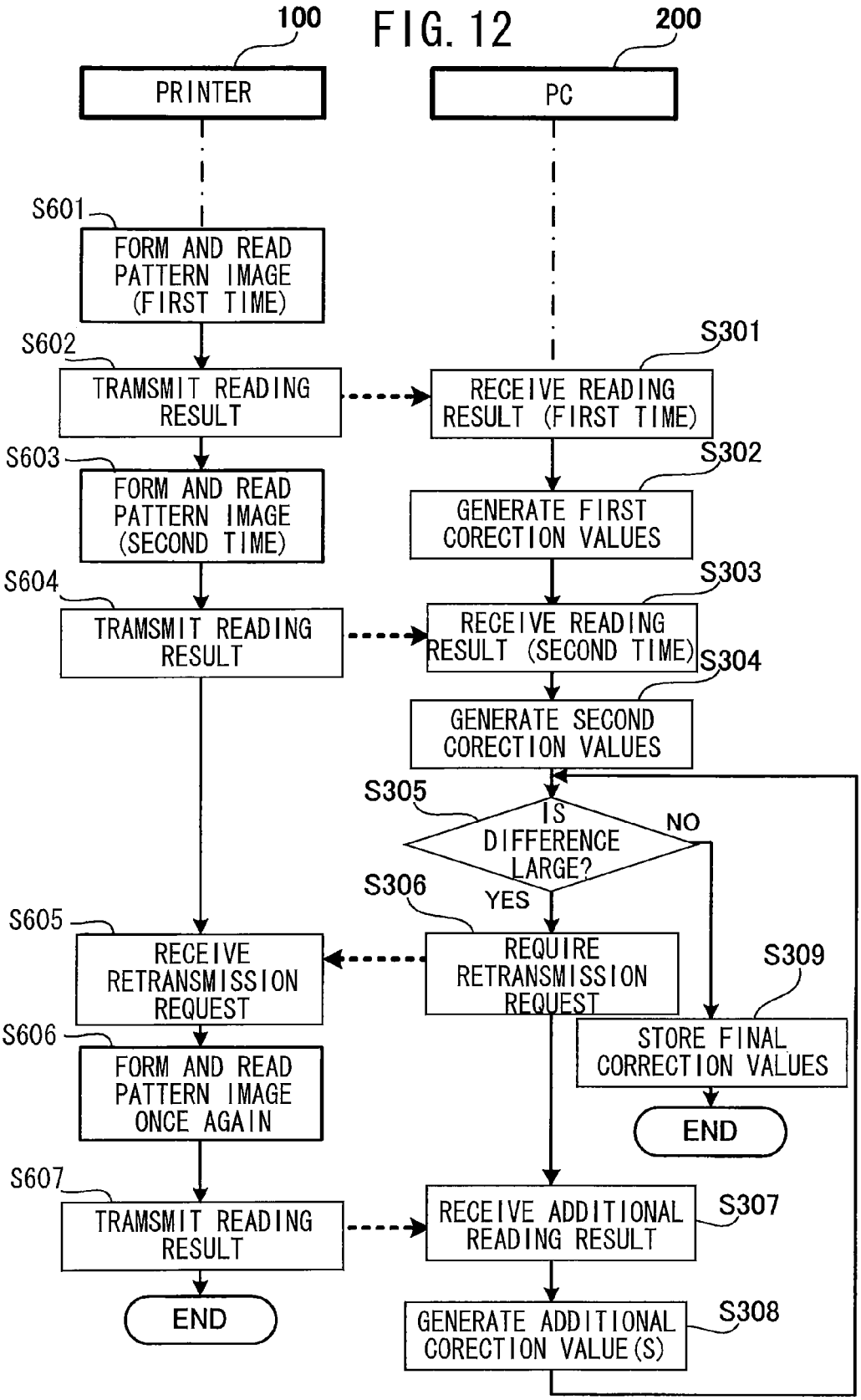
FIG. 12 is a flowchart illustrating a process for calculating a difference according to a modification of the second embodiment.

Further, the PC 200 may perform the determination of step S509. That is, the PC 200 may determine whether the difference is large. For example, as illustrated in FIG. 12, the printer 100 may transmit the reading results of the first and second pattern images to the PC 200, and the PC 200 may calculate the difference between correction values based on the received results. Specifically, in S601 the printer 100 executes the formation process of the pattern image and the reading process of the formed image, and in S602 transmits the reading result to the PC 200. In S301 the PC 200 receives the reading result from the printer 100 and in S302 generates the first correction values. The printer 100 and the PC 200 execute once again the above processes S601, S602, S301, and S302 in S603, S604, S303, and S304 respectively. In S305, the PC 200 then determines whether a difference between the first and second correction values is large, similarly to S509. When determining that the difference is large (S305: YES), in S306 the PC 200 requires the printer 100 to transmit once again the reading result (or requires a retransmission request). In S605, the printer 100 receives the retransmission request, in S606 executes once again the formation process of the pattern image and the reading process of the formed pattern image, in S607 transmits an additional reading result to the PC 200, and ends the this routine. When there is no retransmission request, the printer 100 ends this routine after S604. Further, when there is a further retransmission request after S607, the printer 100 may repeat the processes S605 to S607. In S307 the PC 200 receives the additional reading result, and in S308 generates an additional correction value (or additional correction values). When determining that the difference between the correction values is not large (S305: NO), in S309 the PC 200 stores the final correction values in the storage device 201 (for example, the hard disk) and ends this routine.

Alternatively, the following procedure may be employed. That is, the printer 100 executes the processes up to calculation of the difference and, thereafter transmits the calculated difference to the PC 200 and the PC 200 determines whether the difference is large. That is, S602, S604, S301, and S303 of FIG. 12 are omitted, and the processes up to the calculation of the difference (process S302 and S304, and a part of process S305) is executed by the printer 100.

In the second embodiment, the latest correction values may be transmitted to the PC 200. However, data to be transmitted when the difference between the first and second reading results is small is not limited to the latest correction values. For example, the printer 100 may transmit the first correction value, or a value obtained from the first and second correction values, such as an average value (mean value) or a median value.

Figure 13:
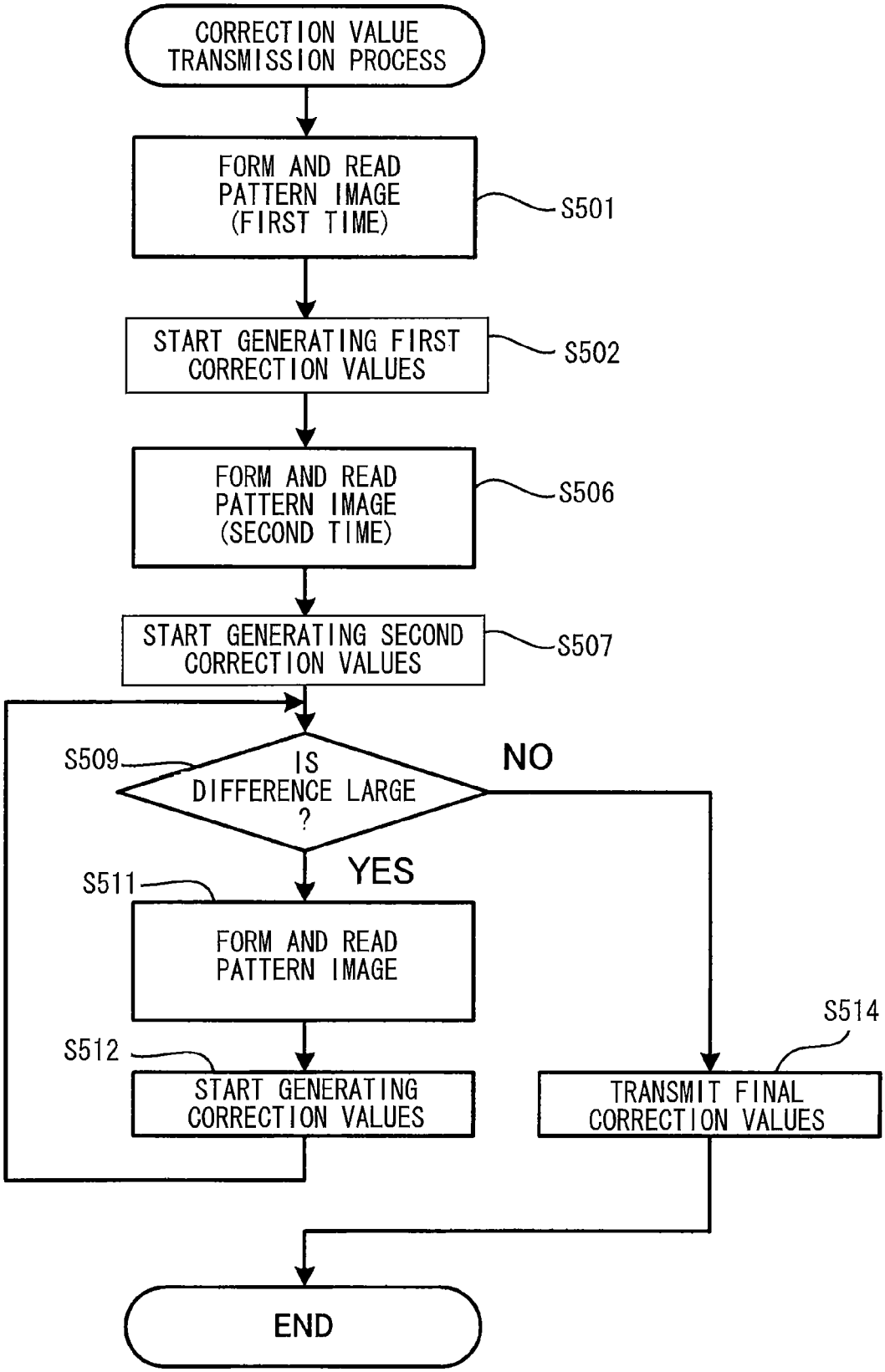
FIG. 13 is a flowchart illustrating a correction value transmission process according to a modification of the second embodiment.

Further, in the second embodiment, when the monochrome image print instruction is received, the printer 100 transmits the first correction value. However, the printer 100 may not transmit the first correction value. For example, as illustrated in the flowchart of FIG. 13, the printer 100 may not determine whether the monochrome image print instruction exists. That is, regardless of whether the monochrome image print instruction is received, the printer 100 may execute twice both the formation process of the pattern image and the reading process of the formed pattern image, and check the difference. Alternatively, in a case where the printer 100 transmits the first correction value after receiving the monochrome image print instruction, the printer 100 may transmit only the correction value for the K color that is required for correction of the monochrome image.

Further, in the second embodiment, when determining that the difference is large, the printer 100 forms only the pattern image of a color or a density for which the difference has been determined to be large. However, the printer 100 may form the pattern images of all colors. When only the pattern image of a color for which the difference has been determined to be large is formed, the toner use amount can be saved. On the other hand, when the pattern images of all colors are formed, a correction value with higher accuracy can be acquired.

Further, in the second embodiment, the displacement correction value and the density correction value are stored in the printer 100. However, the displacement correction value and the density correction value may also be transmitted to the PC 200. In this case, the printer 100 forms the pattern images corresponding to the displacement correction and the density correction and reads the pattern images to acquire the reading results. The reading result for the displacement correction represents a relative position for each combination of colors and that for the density correction represents the density of the pattern image for each color. For example, the PC 200 transmits, prior to transmission of image data, the displacement correction values and the density correction values to the printer 100 so that the printer 100 can adjust a start timing of image formation and a bias voltage value. Further, the printer 100 may transmit the displacement correction values and the density correction values to the PC 200 and store therein the density gradation correction value and values that are not transmitted to the printer 100 among the displacement correction values and the density correction values.

Further, in the second embodiment, the printer 100 executes twice the formation process of the pattern image and the reading process of the formed pattern image. However, when there is a low possibility of density unevenness, and a correction value having especially high reliability is not required, the printer 100 may execute only once the formation process of the pattern image and the reading process of the formed pattern image. This can save the toner use amount and a time required for acquiring the correction values.

While the disclosure has been described in detail with reference to the above embodiments thereof, it would be apparent to those skilled in the art that various changes and modifications may be made therein.

In the above description, the printer 100 is explained as an example of the image forming apparatus. However, the image forming apparatus may be a copier machine, a multifunction peripheral, a facsimile device, an image forming apparatus using an electrophtographic system, instead of the printer 100.

Further, in the embodiments, when the difference between the first and second mark data is large or the difference between the first reading result (the first correction value) and the second reading result (the second correction value), the mark formation process and the reading process of the marks (or the image pattern) are executed once again. However, the mark formation process and the reading process of the marks need not be executed once again. For example, the process may be ended with a display of an error message when the difference is large.

The processes explained above are performed a single CPU, a plurality of CPUs, hardware such as ASIC, and any combination thereof. The processes of the present disclosure are implemented with computer programs stored on a computer-readable storage medium (a non-temporary storage medium, for example). Alternatively, the processes of the present disclosure may be implemented by methods or other manners.

Any part of the processes or components in the first embodiment and its modification can be combined with any part of the processes or components in the second embodiment and its modification.

What is claimed is:

1. An image forming apparatus comprising:

an accommodating chamber configured to accommodate toner; and an agitator provided in the accommodating chamber and configured to agitate the toner;

an image forming unit configured to form an image based on image data by using the toner;

a sensor; and a processor configured to:

determine whether prescribed criterion is met, the prescribed criterion indicating that a non agitation period of time, during which the agitator has not agitated the toner, has passed a predetermined period of time;

perform a mark data generating process in which mark data is generated by forming a mark with the image forming unit and then reading the formed mark with sensor when the prescribed criterion is met;

perform another mark data generating process in which another mark data is generated by forming another mark with the image forming unit and then reading the formed another mark with the sensor after performing the mark data generating process;

determine whether a difference between the mark data and the another mark data is within a prescribed range; and determine an adjustment value to adjust the image on a basis of at least one of the mark data and the another mark data when the difference is within the prescribed range.

2. The image forming apparatus according to claim 1, wherein while mark is formed, the processor is configured to control the agitator to agitate the toner, wherein when the prescribed criterion is met, the mark is formed so that sampling number of the mark is larger than sampling number of the mark when the prescribed criterion is not met.

3. The image forming apparatus according to claim 1, further comprising a first storing unit configured to store first data that varies once mark data is generated, wherein the accommodating chamber includes a second storing unit configured to store second data that varies once mark data is generated, wherein while the mark is formed, the processor is configured to control the agitator to agitate the toner, wherein when the first data indicates that the mark data has not been generated, the mark is formed so that sampling number of the mark is larger than when the first data indicates that the mark data is generated and the second data indicates that the mark data has not been generated.

4. The image forming apparatus according to claim 1, further comprising a first storing unit configured to store first data that varies once mark data is generated, wherein while the mark is formed, the processor is configured to control the agitator to agitate the toner, wherein when the first data indicates that the mark data has not been generated, the mark is formed so that sampling number of the mark is larger than when the first data indicates that the mark data is generated and a specific period of time is longer than a prescribed period of time, the specific period of time being between a time when the image forming apparatus was previously powered off and a time when the image forming apparatus was powered on in a present activation.

5. The image forming apparatus according to claim 1, further comprising a first storing unit configured to store first data that varies once mark data is generated, wherein the processor is configured to determine whether an execution condition for the mark data generating process is met, wherein the processor determines that the prescribed criterion is met when the first data indicates that mark data has not been generated and when the execution condition is met.

6. The image forming apparatus according to claim 1, wherein the accommodating chamber includes a storing unit configured to store specific data that varies once mark data is generated, wherein the processor is further configured to determine whether an execution condition for the mark data generating process is met, wherein the processor determines that the prescribed criterion is met when the specific data indicates that mark data has not been generated and when the execution condition is met.

7. The image forming apparatus according to claim 1, wherein the prescribed criterion is met when a specific period of time is longer than a prescribed period of time, the specific period of time being between a time when the image forming apparatus was previously powered off and a time when the image forming apparatus is turned on in a present activation.

8. The image forming apparatus according to claim 1, wherein the accommodating chamber includes a plurality of accommodating chambers for a plurality of colors, wherein in the mark data generating process, a plurality of sets of mark data for the plurality of colors is generated by forming marks for the plurality of colors in cooperation with the plurality of accommodating chambers and reading the formed marks by the sensor, wherein in the another mark data generating process, a plurality of sets of another mark data for the plurality of colors is generated by forming another marks for the plurality of colors in cooperation with the plurality of accommodating chambers and reading the formed another marks by the sensor.

9. The image forming apparatus according to claim 8, wherein the marks are for a density correction, wherein the processor is further configured to determine whether a difference between a set of mark data and a set of another mark data is within a prescribed range for each of the plurality of colors, the prescribed range varying among at least two of the plurality of colors.

10. The image forming apparatus according to claim 9, wherein the processor is further configured to:

perform an additional mark data generating process, when a difference between a set of mark data and a set of another mark data is out of a prescribed range for a color, to generate a set of additional mark data for the color; and determine whether a difference between the set of another mark data and the set of additional mark data for the color within the prescribed range.

11. The image forming apparatus according to claim 1, wherein the processor is further configured to determine whether an execution condition for the gamma correction is met, wherein the processor is further configured to generate mark data for a gamma correction by controlling the image forming unit to form a plurality of marks having different densities and controlling the sensor to read the plurality of marks when the execution condition for the gamma correction is met, wherein the processor determines that the criterion is met when a specific period of time is longer than a prescribed period of time, the specific period of time being between a time when the image forming apparatus was previously powered off and a time when the image forming apparatus is turned on in a present activation, wherein when the execution condition for the gamma correction is met, the prescribed period of time is set shorter than when the execution condition for the gamma correction is not met.

12. The image forming apparatus according to claim 1, wherein the processor is further configured to determine whether an execution condition for the gamma correction is met, wherein the processor is further configured to generate mark data for a gamma correction by controlling the image forming unit to form a plurality of marks having different densities and controlling the sensor to read the plurality of marks when the execution condition for the gamma correction is met, wherein when the execution condition for the gamma correction is met, the prescribed range is narrower than when condition for the gamma correction is not met.

13. A non-transitory computer readable storage medium storing a set of program instructions installed on and executed by a computer for controlling an image forming apparatus including an accommodating chamber configured to accommodate toner; an agitator provided in the accommodating chamber and configured to agitate the toner; an image forming unit configured to form an image based on image data by using the toner; and a sensor, the program instructions comprising:

determining whether prescribed criterion is met, the prescribed criterion indicating that a non agitation period of time, during which the agitator has not agitated the toner, has passed a predetermined period of time;

performing a mark data generating process in which mark data is generated by forming a mark with the image forming unit and then reading the formed mark with sensor when the prescribed criterion is met;

performing another mark data generating process in which another mark data is generated by forming another mark with the image forming unit and then reading the formed another mark with the sensor after performing the mark data generating process;

determining whether a difference between the mark data and the another mark data is within a prescribed range; and determining an adjustment value to adjust the image on a basis of at least one of the mark data and the another mark data when the difference is within the prescribed range.

14. A method for controlling an image forming apparatus including an accommodating chamber configured to accommodate toner; an agitator provided in the accommodating chamber and configured to agitate the toner; an image forming unit configured to form an image based on image data by using the toner; and a sensor, the method comprising:

determining whether prescribed criterion is met, the prescribed criterion indicating that a non agitation period of time, during which the agitator has not agitated the toner, has passed a predetermined period of time;

performing a mark data generating process in which mark data is generated by forming a mark with the image forming unit and then reading the formed mark with sensor when the prescribed criterion is met;

performing another mark data generating process in which another mark data is generated by forming another mark with the image forming unit and then reading the formed another mark with the sensor after performing the mark data generating process;

determining whether a difference between the mark data and the another mark data is within a prescribed range; and determining an adjustment value to adjust the image on a basis of at least one of the mark data and the another mark data when the difference is within the prescribed range.

* * * * *